US009540911B2

(12) United States Patent
Stone et al.

(10) Patent No.: US 9,540,911 B2
(45) Date of Patent: Jan. 10, 2017

(54) CONTROL OF MULTIPLE TUBING STRING WELL SYSTEMS

(75) Inventors: Terry Stone, Kingsworthy (GB); David J. Browning, Dorking (GB)

(73) Assignees: Schlumberger Technology Corporation, Sugar Land, TX (US); Chevron U.S.A. Inc., San Ramon, CA (US)

( * ) Notice: Subject to any disclaimer, the term of this patent is extended or adjusted under 35 U.S.C. 154(b) by 1313 days.

(21) Appl. No.: 12/961,737

(22) Filed: Dec. 7, 2010

(65) Prior Publication Data

US 2011/0320047 A1 Dec. 29, 2011

Related U.S. Application Data

(60) Provisional application No. 61/358,075, filed on Jun. 24, 2010.

(51) Int. Cl.

| | |
|---|---|
| ***G06G 7/48*** | (2006.01) |
| ***E21B 43/00*** | (2006.01) |
| *E21B 43/14* | (2006.01) |

(52) U.S. Cl.
CPC ..... *E21B 43/00* (2013.01); *E21B 43/14* (2013.01)

(58) Field of Classification Search
CPC ..... E21B 43/14
USPC ..... 703/10
See application file for complete search history.

(56) References Cited

U.S. PATENT DOCUMENTS

| | | | |
|---|---|---|---|
| 5,547,029 A * | 8/1996 | Rubbo et al. | 166/375 |
| 6,945,331 B2 | 9/2005 | Patel | |
| 7,004,252 B2 | 2/2006 | Vice | |
| 7,079,952 B2 | 7/2006 | Thomas et al. | |
| 7,108,073 B2 | 9/2006 | Patel | |
| RE39,583 E | 4/2007 | Upchurch | |
| 7,325,616 B2 | 2/2008 | Lopez de Cardenas et al. | |
| 7,387,165 B2 | 6/2008 | Lopez de Cardenas et al. | |

(Continued)

OTHER PUBLICATIONS

S. Livescu et al., "A fully-coupled thermal multiphase wellboreflow model for use in reservoir simulation," 2009, Journal of Petroleum Science and Engineering 71 (2010) 138-146.*

(Continued)

*Primary Examiner* — Hugh Jones
(74) *Attorney, Agent, or Firm* — Colin L. Wier; Rodney Warfford; Alec McGinn

(57) ABSTRACT

Design and control of well systems with multiple tubing strings is described. An example system models multiple tubing strings in wellbores as segments, with multiple control points selectively located among the segments. Each segment is modeled as one or more equations that describe characteristics of a fluid resource associated with the segment. The system can predict flow of fluids and energy in a wellbore by solving physical conservation equations subject to specified conditions. The system models multiple control points, and solves the equations to convergence to satisfy injection and production targets and specified constraints. Results may be used to improve production of the resource. The system can apply a variety of strategies to model wells via multiple control points, including conservation of mass and energy models, a global phase-component partitioning model, a conductive heat transfer model, a pseudo-pressure model, a non-Darcy flow model, a phase separation model, and so forth.

18 Claims, 16 Drawing Sheets

(56) References Cited

U.S. PATENT DOCUMENTS

| | | | | |
|---|---|---|---|---|
| 7,640,977 | B2 | 1/2010 | Jonas | |
| 7,668,707 | B2 * | 2/2010 | Watts et al. | 703/10 |
| 2003/0139916 | A1 * | 7/2003 | Choe et al. | 703/10 |
| 2005/0038603 | A1 * | 2/2005 | Thomas et al. | 702/6 |
| 2005/0115713 | A1 | 6/2005 | Restarick | |
| 2005/0161222 | A1 | 7/2005 | Haugen | |
| 2005/0167109 | A1 | 8/2005 | Hepburn | |
| 2005/0167110 | A1 | 8/2005 | Smith | |
| 2005/0167111 | A1 | 8/2005 | Smith | |
| 2005/0167112 | A1 | 8/2005 | Smith | |
| 2005/0167113 | A1 | 8/2005 | Smith | |
| 2005/0167114 | A1 | 8/2005 | Smith | |
| 2005/0167115 | A1 | 8/2005 | Smith | |
| 2005/0173121 | A1 | 8/2005 | Steele | |
| 2005/0178554 | A1 | 8/2005 | Hromas | |
| 2005/0178555 | A1 | 8/2005 | Smith | |
| 2005/0189114 | A1 | 9/2005 | Zupanick | |
| 2005/0241830 | A1 | 11/2005 | Steele | |
| 2005/0241831 | A1 | 11/2005 | Steele | |
| 2005/0263287 | A1 | 12/2005 | Achee | |
| 2006/0000614 | A1 | 1/2006 | Restarick | |
| 2006/0027370 | A1 | 2/2006 | Weinrich | |
| 2006/0027371 | A1 | 2/2006 | Gorrara | |
| 2006/0090898 | A1 | 5/2006 | Tyrrell | |
| 2006/0124310 | A1 | 6/2006 | Lopez de Cardenas | |
| 2006/0124311 | A1 | 6/2006 | Lopez de Cardenas | |
| 2006/0124312 | A1 | 6/2006 | Rytlewski | |
| 2006/0131024 | A1 | 6/2006 | Zupanick | |
| 2006/0131025 | A1 | 6/2006 | Seams | |
| 2006/0131026 | A1 | 6/2006 | Pratt | |
| 2006/0191688 | A1 | 8/2006 | Murray | |
| 2006/0196668 | A1 | 9/2006 | Burge | |
| 2006/0201677 | A1 | 9/2006 | Moody | |
| 2006/0207764 | A1 | 9/2006 | Rytlewski | |
| 2006/0207765 | A1 | 9/2006 | Hofman | |
| 2006/0231260 | A1 | 10/2006 | Freyer | |
| 2006/0231261 | A1 | 10/2006 | Tjader | |
| 2006/0278396 | A1 | 12/2006 | Sotomayor | |
| 2007/0084605 | A1 | 4/2007 | Walker et al. | |
| 2007/0107902 | A1 | 5/2007 | Jelsma | |
| 2007/0112547 | A1 * | 5/2007 | Ghorayeb et al. | 703/10 |
| 2007/0114037 | A1 | 5/2007 | Van Helvoirt | |
| 2007/0158073 | A1 | 7/2007 | Green | |
| 2007/0163781 | A1 | 7/2007 | Walker | |
| 2007/0181308 | A1 | 8/2007 | Jelsma | |
| 2007/0221380 | A1 | 9/2007 | Restarick | |
| 2007/0271077 | A1 * | 11/2007 | Kosmala et al. | 703/5 |
| 2009/0138213 | A1 * | 5/2009 | Watts et al. | 702/45 |
| 2009/0276100 | A1 * | 11/2009 | Malki et al. | 700/282 |
| 2009/0294122 | A1 * | 12/2009 | Hansen et al. | 166/250.01 |
| 2010/0051280 | A1 * | 3/2010 | Akram | 166/303 |
| 2010/0076738 | A1 * | 3/2010 | Dean et al. | 703/7 |
| 2010/0131257 | A1 * | 5/2010 | Watts et al. | 703/10 |
| 2010/0250215 | A1 * | 9/2010 | Kennon et al. | 703/10 |
| 2010/0250216 | A1 * | 9/2010 | Narr et al. | 703/10 |
| 2010/0299111 | A1 * | 11/2010 | Dale et al. | 703/2 |
| 2010/0299125 | A1 * | 11/2010 | Ding et al. | 703/10 |

OTHER PUBLICATIONS

A. Semenova et al., "Modeling of Multisegmented Thermal Wells in Reservoir Simulation," Society of Petroleum Engineers EUROPEC/EAGE Annual Conference and Exhibition held in Barcelona, Spain, Jun. 14-17, 2010.*

C. Perez-Damas, "Application of Avant-Garde Simulation Technology to Explore the Complexity of the SAGD Process," 2006, Proceedings at the 1st Heavy Oil Conference.*

P.A. Vander Valk and P. Yang, "Investigation of Key Parameters in SAGD Wellbore Design and Operation," Jun. 2007, JCPT, vol. 46, No. 6, pp. 49-56.*

Q. Chen, "Assessing and Improving Steam-Assisted Gravity Drainage: Reservoir Heterogeneities, Hydraulic Fractures, and Mobility Control Foams," A Dissertation Submitted to the Department of Energy Resources Engineering and the Committee on Graduate Studies of Stanford University, May 2009.*

Schlumberger, "PVTi and ECLIPSE 300, An Introduction to PVT analysis and compositional simulation," Abingdon Technology Center Training, 2005.*

Examination Report dated Jan. 14, 2013 for Canadian Patent Application No. 2,738,378 (2 pages).

Oballa, V., Buchanan, L., "Flexible Wellbore Model Coupled to Thermal Reservoir Simulator", paper 2009-308 presented and published in the World Heavy Oil Congress 2009 Proceedings.

Holmes, J.A., Barkve, T., Lund, O.: "Application of a Multisegment Well Model to Simulate Flow in Advanced Wells", SPE 50646 presented at the 1998 SPE European Petroleum Conference, The Hague, The Netherlands, Oct. 20-22, 1998.

Holmes, J.A.: "Enhancements to the Strongly Coupled, Fully Implicit Well Model: Wellbore Crossflow Modeling and Collective Well Control", SPE 12259 presented at the SPE Reservoir Simulation Symposium held in San Francisco, CA, Nov. 15-18, 1983.

Stone, T. W., Bennett, J., Law, D. H.-S., Holmes, J. A., "Thermal Simulation with Multisegment Wells", SPE 66373 presented at the 2001 SPE Reservoir Simulation Symposium, Houston Texas, Feb. 11-14, 2001.

K. Neylon, E. Reiso, J. A. Holmes, O. B. Nesse, "Modeling Well Inflow Control with Flow in Both Annulus and Tubing", SPE 118909 presented at the 2009 SPE Reservoir Simulation Symposium, The Woodlands, Texas, Feb. 2-4, 2009.

Watts, J. W., Fleming, G. C., Lu, Q., "Determination of Active Constraints in a Network", SPE 118877 presented at the 2009 SPE Reservoir Simulation Symposium, The Woodlands, Texas, Feb. 2-4, 2009.

Tan, T.B., Butterworth, E., Yang, P., "Application of a Thermal Simulator with Fully Coupled Discretized Wellbore Simulation to SAGD", Journal of Canadian Petroleum Technology, vol. 41, No. 1, Jan. 2002.

* cited by examiner

CONTROL OF MULTIPLE TUBING STRING WELL SYSTEMS

RELATED APPLICATIONS

This patent application claims priority to U.S. Provisional Patent Application No. 61/358,075 to Stone et al., entitled, "Using Tubing Strings and Controlling Fluid Injection and Production from Wells," filed Jun. 24, 2010, and incorporated herein by reference in its entirety.

BACKGROUND

Well operators around the world are increasingly using wells with multiple tubing strings to improve both injection and production of fluids in a reservoir. Some operators are now using this technology for designing and optimizing thermal, heavy oil recovery. Wells with multiple tubing strings are also being used for isothermal and other operations.

Injection and production control can be based on user-specification of a set of flow rate and pressure constraints at a point in a well where the most constraining limit is determined by a model. Injection and production at a point within the wellbore and not just at the wellhead (the well's output to the surface) is increasingly being employed for (i) recirculation of fluids, for example in steam assisted gravity drainage (SAGD) processes, (ii) for artificial gas lift, (iii) for placement of injection fluids, e.g., steam placement in thermal operations, (iv) for control of production along a wellbore, e.g., in a long horizontal well utilizing sliding tubing strings. Additionally Inflow Control Device (ICD) and Flow Control Valve (FCV) constraint devices are being used to improve production from layers or compartments in a reservoir.

Multiple tubing strings in a well present the dual problem of both design and control. There is need for a rigorous, accurate, and robust method to model these multi-tubing string wells as part of the reservoir simulation stage of "field planning and development" in order to properly design the wells, and in order to improve resource production (i.e., optimal control of the optimal design). In particular, there is a need to control the individual tubing strings with ICD and FCV devices and allow injection and production at various control points along the tubing strings in addition to the single, overall well control.

SUMMARY

Design and control of well systems with multiple tubing strings is described. An example system models multiple tubing strings in wellbores as segments, with multiple control points selectively located among the segments. Each segment is modeled as one or more equations that describe behavior and characteristics of a fluid resource associated with the segment. The system can predict flow of fluids and energy in a wellbore by solving physical conservation equations subject to specified conditions. The system models multiple control points, and then solves the equations modeling all the segments to convergence to satisfy injection and production targets and specified constraints. Results may be used to balance or improve production of the resource. The system can apply a variety of strategies using multiple control points to model the wells, including conservation of mass and energy models, a global phase-component partitioning model, a conductive heat transfer model, a pseudo-pressure model, a non-Darcy flow model, a phase separation model, and so forth.

Each control point may be modeled as a boundary segment defined by an open chord to which a control mode constraint construct is assigned. A chord consists of an extra pipe linked to a segment node. The other end (or outlet end) of the chord pipe is then linked to another segment node in order to specify looped flow paths within the well model. In the example system, however, instead of attaching the outer end of the chord to another segment node to form a loop, the chord is instead left unattached (similar to the wellhead segment where the segment pipe is unattached for flow to the surface). The pressure drop equation for this open chord is replaced with a control mode constraint equation. These segments with an additional unattached chord are called boundary segments. Mass and energy flowing in the boundary segments can be accounted for in the overall mass and energy conservation of the segment. The boundary segments can be added to the well at any number of locations within the well including branches and tubing strings.

In one implementation, an example system determines a desirable overall constraint mode for the wellhead segment and then heuristically applies an iterative method to calculate constraint modes for the boundary segments, i.e., for the multiple control points.

This summary section is not intended to give a full description of design and control of multiple tubing string well systems, or to provide a comprehensive list of features and elements. A detailed description with example implementations follows.

DETAILED DESCRIPTION

Overview

Figure 1:
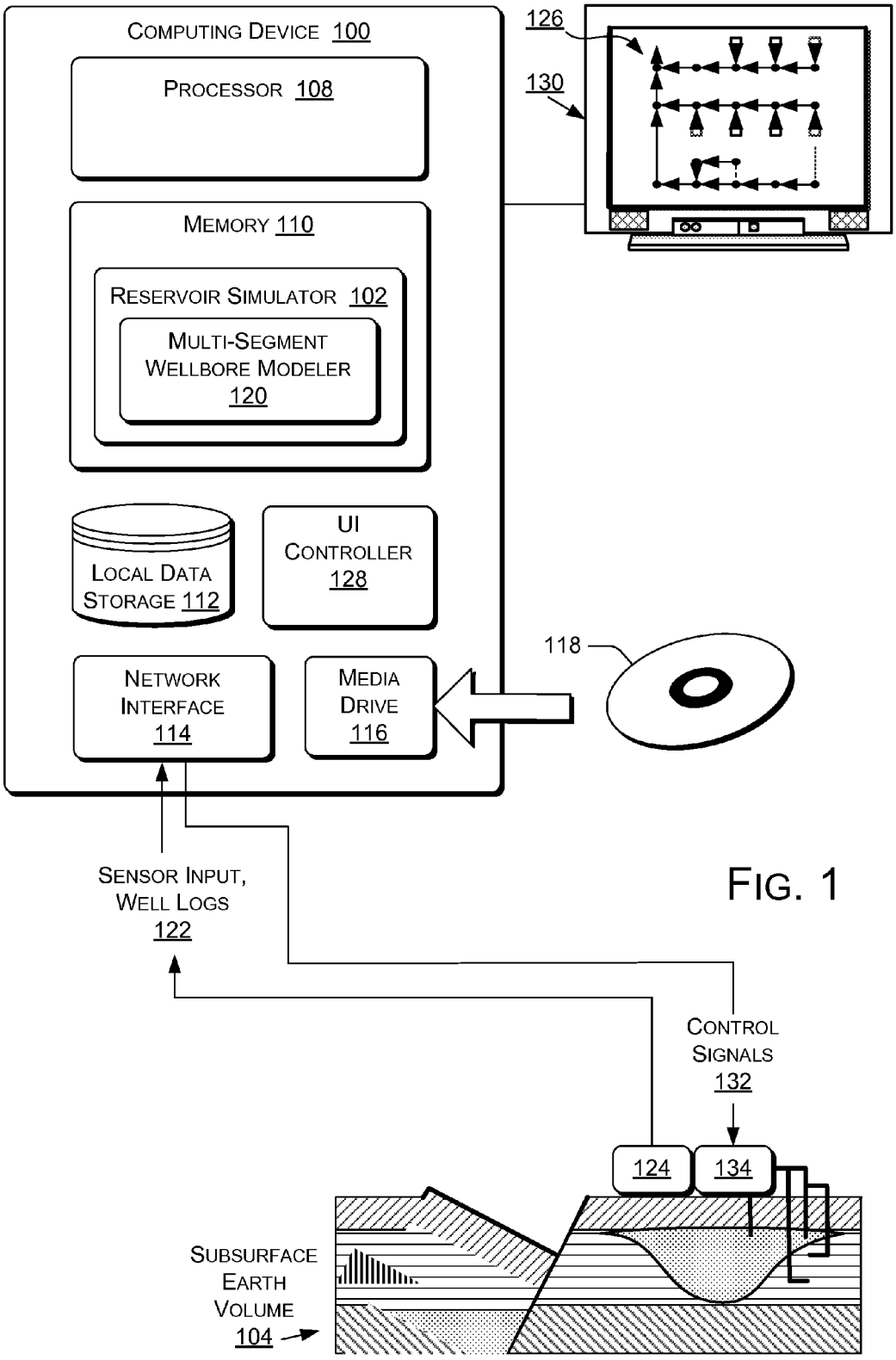
FIG. 1 is a diagram of an example modeling and control environment for design and control of well systems with multiple tubing strings.

This disclosure describes systems and methods for designing and controlling multiple tubing string well systems. An example system models multiple tubing strings in wellbores as segments, with multiple control points selectively located among the segments. Each segment can be modeled as one or more equations that describe behavior and characteristics of a fluid resource associated with the segment. The system can predict flow of fluids and energy in a wellbore by solving physical conservation equations subject to specified conditions. The system models multiple control points, and then solves the equations modeling all the segments of the well system to convergence to satisfy injection and production targets and specified constraints. Results may be used to balance or improve production of the resource.

In one implementation, an example system simultaneously solves equations modeling a multi-segment well model to allow multiple injection or production control points within both the main wellbore and within any number of tubing strings. At each control point, for example, a set of rate and pressure limits may be set where the most constraining limit is automatically selected and a control mode is determined at that point. The example system may prioritize or rank the set of rate and pressure limits associated with these control points, using an ability to simultaneously solve the well equations when multiple control points are present. The example system can then solve the complex problem of designing a well containing multiple tubing strings in which injection and production are taking place at various points in the well and strings and thereby design wells for optimizing field-wide production of fluids.

To allow multiple injection and production control points in a well, each of which can have one or more rate or pressure limits and where the most constraining limit is automatically chosen, an example system uses the concept of a chord. However, instead of attaching the outer end of the chord to another segment node thus forming a loop, the chord is left unattached (similar to the wellhead segment where the segment pipe is unattached so that flow in this pipe can be directed to surface). The pressure drop equation along the chord is then replaced with a control mode constraint equation. These special segments with an additional unattached chord are called boundary segments.

Mass and energy flowing in these boundary segments are accounted for in the overall mass and energy conservation of the segment. Boundary segments can be added to the well at any number of locations within the well including branches.

In one implementation, example methods to determine the most constraining limit in the boundary segments are heuristic, i.e., the well control mode for the overall well system (e.g., the wellhead segment) is determined first after which all boundary segment control modes are then determined by modeling with the well control mode set.

However the presence of multiple boundary segments within the well model may (i) have multiple solutions, (ii) may not allow the overall well control mode to be satisfied due to the system being over-constrained. The example system can find an acceptable solution to a well that contains multiple boundary segments in addition to a wellhead segment.

In one implementation the example system uses modified slack variables on all control points (boundary and wellhead segments, each of which may have a set of user specified flow rate and pressure limits) in order to determine which limit at each point is active or inactive. In one implementation, if a control limit is violated, a heuristic algorithm is applied that evaluates the worst offender and switches to that control mode. If the user has specified several limits at one control point in the system, e.g., oil production rate, water production rate, pressure limit, then a slack variable and multiplier can be assigned to each of these even though all of these limits exist at the same point.

The example system can assist the design of wells with multiple tubing strings and control fluid injection and production from these wells by modeling the multiple control points. The example system provides significant improvements over previous conventional systems. These include:

- more flexibility in specifying a wellbore multi-segment topology;
- improved robustness through use of new equation formulations, data structures and linear/nonlinear solvers;
- enhanced methods for handling well, segment, and boundary segment constraints;
- new and/or modified well model options; and
- new and/or enhanced implementation features including data containers, linear and nonlinear solvers, code design, and parallel solutions.

Example Multiple Tubing String Well Environment

FIG. 1 shows rudiments of an example system in which design and control of multiple tubing string well systems can be implemented. In this implementation, a computing device 100 implements a component, such as a geologic or reservoir simulator 102 that models a subsurface earth volume, such as a depositional basin, petroleum reservoir, seabed, etc, containing wellbores. The simulator 102 is illustrated as software, but can be implemented as hardware or as a combination of hardware and software instructions.

In the illustrated example, the computing device 100 is communicatively coupled via sensory and control devices with real-world wells in a "subsurface earth volume" 104, i.e., an actual earth volume, petroleum reservoir, depositional basin, seabed, etc., with wells, surface control network, and so forth. The computing device 100 may be in communication with wells for producing a petroleum resource, but the computing device 100 may alternatively be in communication with wells for other uses, for example, water resource management, carbon services, and so forth.

The computing device 100 may be a computer, computer network, or other device that has a processor 108, memory 110, data storage 112, and other associated hardware such as a network interface 114 and a media drive 116 for reading and writing a removable storage medium 118. The removable storage medium 118 can be, for example, a compact disk (CD); digital versatile disk/digital video disk (DVD); flash drive, etc., The simulator 102 includes a multi-segment wellbore modeler 120, either integrated as part of the fabric of the simulator 102; as a separate module in communication with the simulator 102; or as a retrofit module added on, for example, to an updated version of the simulator 102.

The removable storage medium 118 may include instructions for implementing and executing the multi-segment wellbore modeler 120. At least some parts of the multi-segment wellbore modeler 120 can be stored as instructions on a given instance of the removable storage medium 118, removable device, or in local data storage 112, to be loaded into memory 110 for execution by the processor 108.

Although the illustrated simulator 102 is depicted as a program residing in memory 110, a simulator 102 may be implemented as hardware, such as an application specific integrated circuit (ASIC) or as a combination of hardware and software.

In this example system, the computing device 100 receives field data, such as well logs and well data 122 from a device 124 in communication with one or more wellbores in a well system 134 that may have multiple tubing strings. The computing device 100 can receive the well data 122 from the well system 134 via the network interface 114.

The computing device 100 may compile modeling and control results, and a display controller 128 (user interface) may output geologic model images or well system simulations 126, such as a 2D or 3D visual representation of the well system 134, tubing strings, and controllers, as well as layers or rock properties in a subsurface earth volume 104, on a display 130. The display controller 128 may also generate a visual user interface (UI) for input of user data, by a user. The displayed well system simulations 126 are based on the output of the multi-segment wellbore modeler 120. The multi-segment wellbore modeler 120 may perform other modeling and control operations and generate useful user interfaces via the display controller 128, including novel interactive graphics, for user control of multi-tubing string well systems.

Besides modeling optimal well system and tubing string designs for increasing products and/or reducing cost in a well system, in one implementation the multi-segment wellbore modeler 120 can also generate control signals 132 to be used via control devices in real world control of the well system 134 with multiple tubing strings as explained in greater detail below, including direct control via hardware control devices of such resources as injection and production control points in wells, reservoirs, fields, transport and delivery systems, and so forth.

Example Engine and Platform

Figure 2:
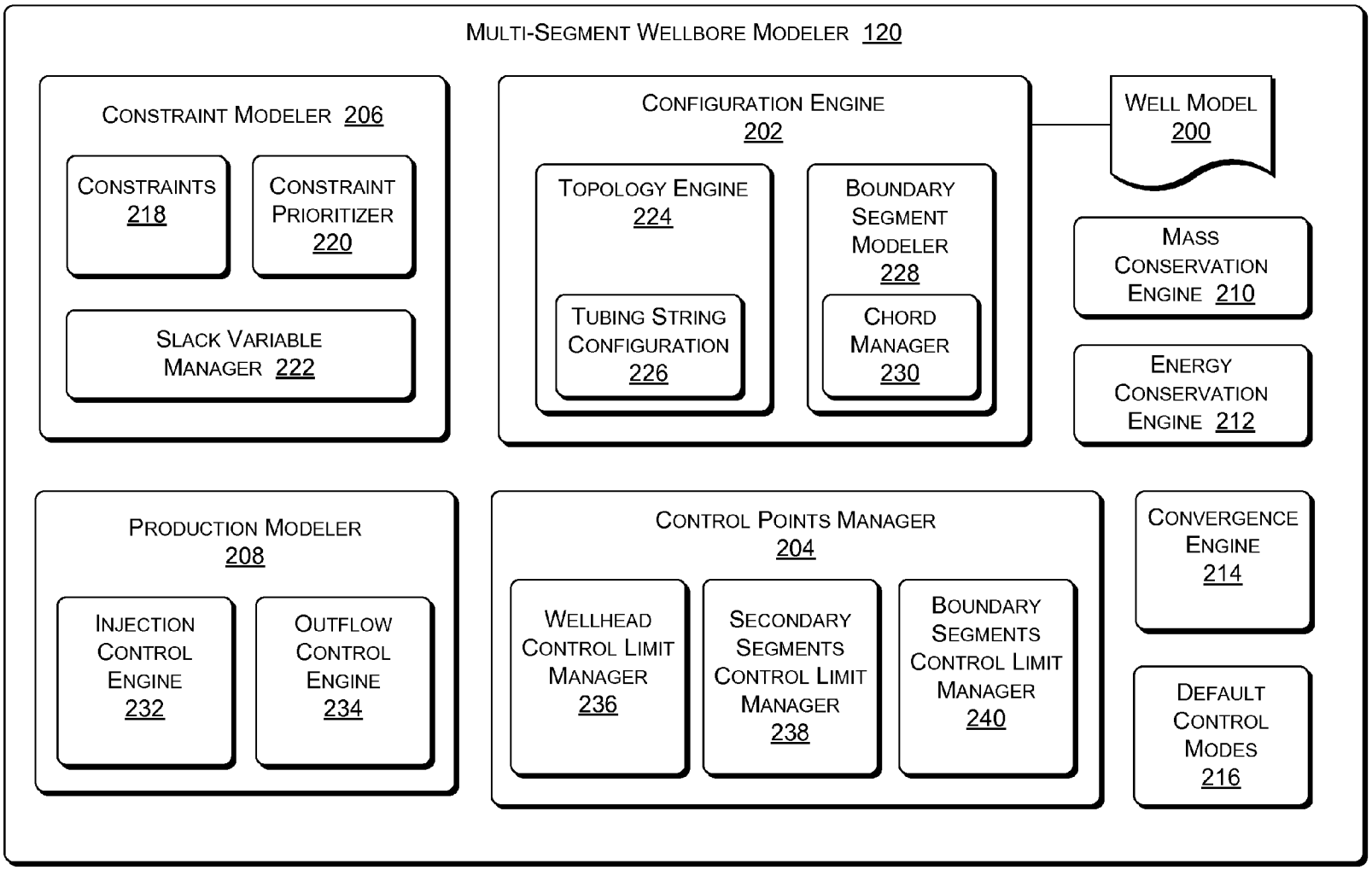
FIG. 2 is a block diagram of an example multi-segment wellbore modeler.

FIG. 2 shows an example multi-segment wellbore modeler 120 in greater detail than in FIG. 1. The illustrated implementation is only one example configuration for the sake of description, to introduce features and components of an engine that performs innovative design and control using tubing strings and controlling fluid injection and production from wells. The illustrated components are only examples. Different configurations or combinations of components than those shown may be used to perform the functions, and different or additional components may also be used. Many other arrangements of the components and/or functions of a multi-segment wellbore modeler 120 are possible within the scope of the subject matter. As introduced above, the multi-segment wellbore modeler 120 can be implemented in hardware, or in combinations of hardware and software. Illustrated components are communicatively coupled with each other for communication as needed.

The example multi-segment wellbore modeler 120 of FIG. 2 includes a configuration engine 202, a control points manager 204, a flow constraint modeler 206, a production modeler 208, a mass conservation engine 210, an energy conservation engine 212, a convergence engine 214, and a database or buffer of default control modes 216.

The configuration engine 202 may further include a topology engine 224 that generates or stores a tubing string configuration 226, and a boundary segment modeler 228 that includes a chord manager 230.

The control points manager 204 may further include a wellhead control limit manager 236, a secondary segments control limit manager 238, and a boundary segments control limit manager 240.

The flow constraint modeler 206 further includes stored constraints 218 and constraint prioritizer 220, and may include a slack variable manager 222.

The production modeler 208 may further include an injection control engine 232 and an outflow control engine 234.

The operation of the example multi-segment wellbore modeler 120 of FIG. 2 will be described in greater detail further below. But immediately following, the multi-segment wellbore modeler 120 just described may also be used as a significant component in a larger modeling and control platform shown in FIG. 3, multi-segment well system modeling platform 302, described next.

Figure 3:
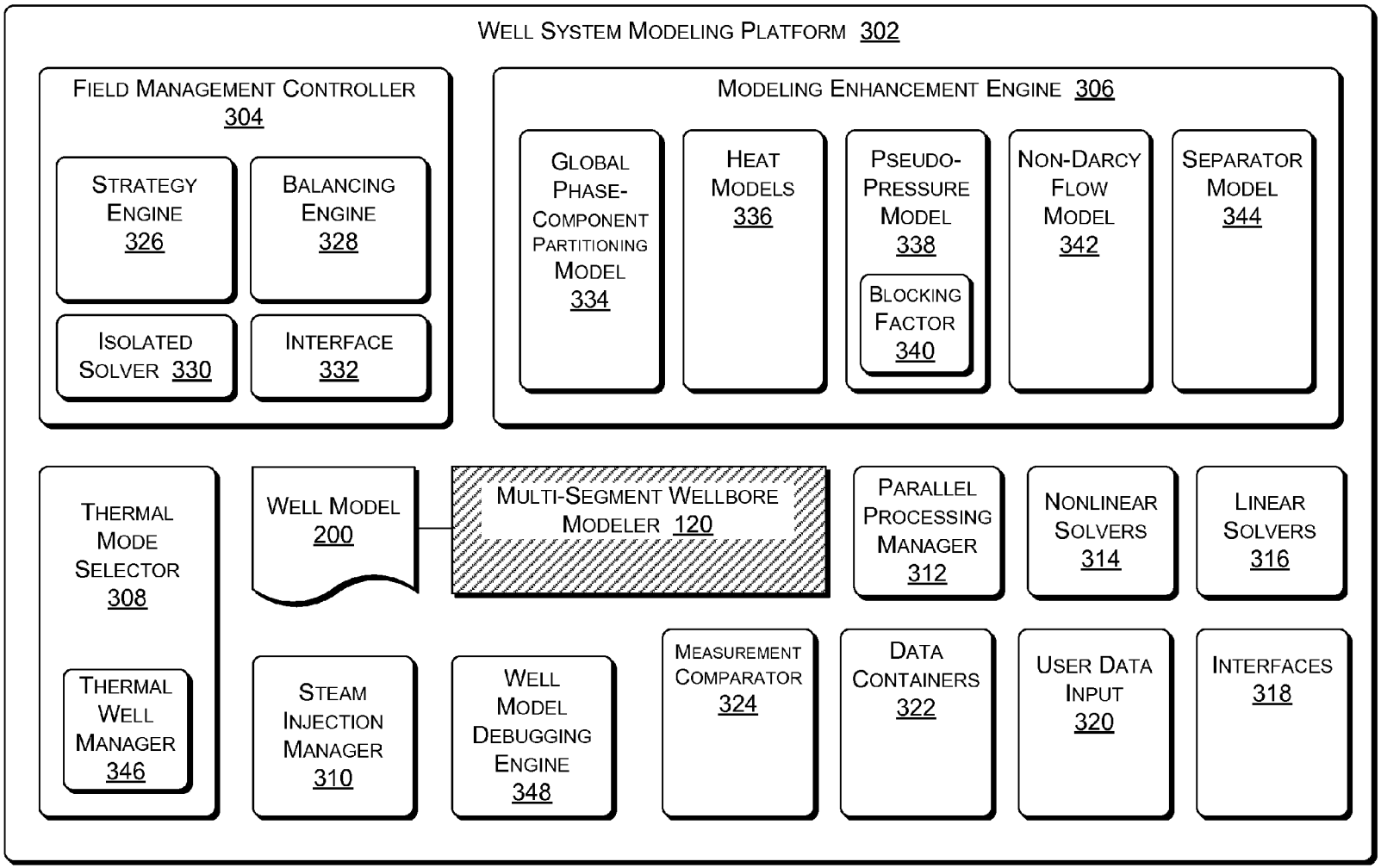
FIG. 3 is a block diagram of an example well system modeling platform.

FIG. 3 shows an example well system modeling platform 302 that includes the multi-segment wellbore modeler 120 of FIG. 2. The illustrated implementation shown in FIG. 3 is only one example configuration for the sake of description, to introduce features and components of a platform that performs innovative well system optimizing. The illustrated components are only examples. Different configurations or combinations of components than those shown may be used to perform the functions, and different or additional components may also be used. Many other arrangements of the components and/or functions of a well system modeling platform 302 are possible within the scope of the subject matter. The well system modeling platform 302 can be implemented in hardware, or in combinations of hardware and software. Illustrated components are communicatively coupled with each other for communication as needed.

The example well system modeling platform 302 of FIG. 3 includes the multi-segment wellbore modeler 120; a field management controller 304, a modeling enhancement engine 306, a thermal well manager 346, a steam injection & production manager 310, a parallel processing manager 312, nonlinear solvers 314, linear solvers 316, interfaces 318 for receiving external data, a user data input 320, data containers 322, and a measurement comparator 324.

The field management controller 304 may further include a strategy engine 326, a balancing engine 328, an isolated solver 330, and an interface 332, especially when the field management controller 304 is external to, or remote from, other components of the well system modeling platform 302.

The modeling enhancement engine 306 may further include a global phase-component partitioning model 334, heat models 336, a pseudo-pressure model 338 that may apply a blocking factor 340, a non-Darcy flow model 342, and a separator model 344.

The thermal well manager 346 may further include a thermal mode selector 308, and the overall well system modeling platform 302 may also include a well model debugging engine 348.

This configuration of example components is for describing one possible implementation, and for showing interrelationships between functions of an example well system modeling platform 302. Other components and configurations could also be used to implement the inventive subject matter.

Operation of the Example Engine and Platform

The example multi-segment wellbore modeler 120 and the well system modeling platform 302 can provide a myriad of optimization methods. This in turn creates several variations of an example system.

A component in any commercial reservoir simulator is a well model 200. Conventionally, the well model 200 provides the source and sink terms that control the progress of the reservoir simulation. It can determine the flow contributions from each of the connecting reservoir grid cells while the well operates under a variety of possible control modes. In the multi-segment wellbore modeler 120, the configuration engine 202 can create a dynamic well model 200. In addition, the wellbore modeler 202 has a topology engine 224 that can rearrange segments in a model well system 134, in order to achieve an ideal or optimal tubing string configuration 226. The boundary segment modeler 288, another component of the wellbore modeler 202, includes a chord manager 230 for flexibly designating control points anywhere in a well or in tubing strings. Thus, the configuration engine 202, while creating a well model 200, also provides enhanced functionality for modifying and optimizing well designs.

In one implementation, in designing a well model 200 that uses tubing strings, the multi-segment wellbore modeler 120 has a production modeler 208 with an injection control engine 232 and an outflow control engine 234, which accurately and flexibly controls fluid injection and production parameters at any point in the well system 134 and tubing strings. The production modeler 208 has access to a modeled set of flow rate & pressure constraints 218 from the constraint modeler 206. This enables a field reservoir engineer, for example, to design and improve the placement, flow rates, and control of wells in order to improve overall field production. Besides optimizing modeling and design of well systems, the multi-segment wellbore modeler 120 may also be used to actually control a real world well system 134.

In another implementation, in designing well systems that use tubing strings and that control fluid injection and production from the wells, the multi-segment wellbore modeler 120 has a control points manager 204 that simultaneously solves equations in various multi-segment well models 200 to allow multiple injection or production control points within both the main wellbore and within any number of tubing strings. At one or more control points, a set of constraints 218 may be placed and the constraint modeler 206 can automatically select the most constraining limit and a control mode 216 can be determined at that control point.

In another implementation, in designing well systems 134 that use tubing strings and control fluid injection and production from wells, the multi-segment wellbore modeler 120 includes a constraint prioritizer 220 to prioritize or rank the set of rate & pressure limits 218 associated with multiple control points. In this implementation, the multi-segment wellbore modeler 120 can improve production by simultaneously solving the well equations when multiple control points are present. This can assist in designing a complex well including multiple tubing strings in which injection and production are taking place at various points in the well and tubing strings, thereby optimizing field-wide production of fluids.

In another implementation, in designing well systems 134 that use tubing strings and control fluid injection and production from wells, the multi-segment wellbore modeler 120 models multiple injection and production control points in a well, each of which can have one or more rate & pressure limits 218 and in which the most constraining limit is automatically selected. In this implementation, a topology engine 224 adopts a multi-segment model of the well system 134 using one or more chords.

Figure 4:
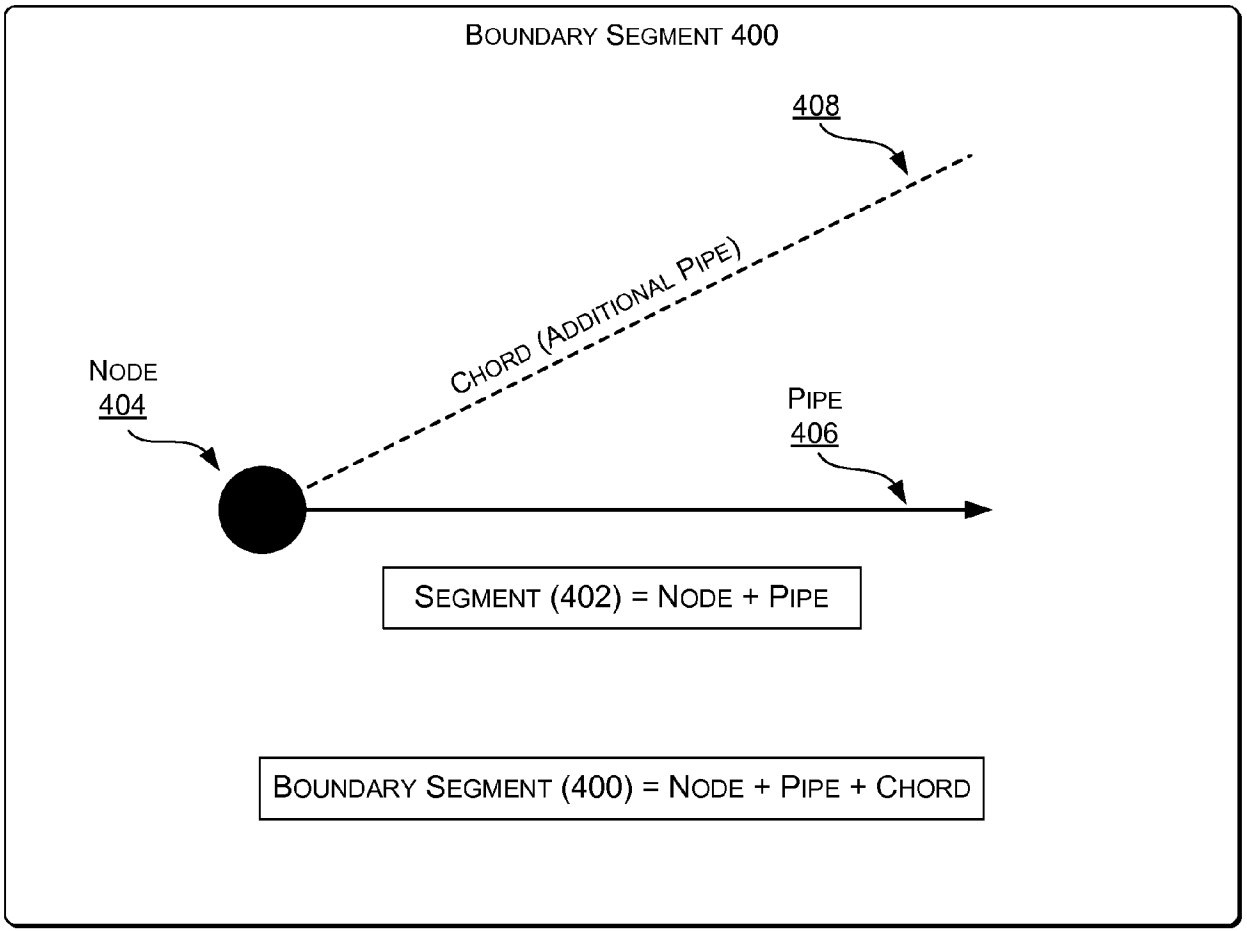
FIG. 4 is a diagram of example boundary segment.

FIG. 4 shows a boundary segment 400. As shown in FIG. 4, a segment 402 consists of a node 404 and a pipe 406, which make up a section of a well or a tubing string. A chord 408 is an additional pipe connected to the node 404 of a segment 402. A chord 408 may either connect to another segment to form a closed loop or the chord 408 may remain unconnected. Instead of attaching the outer end of the chord 408 to another segment node 404 thus forming a loop, the chord 408 may be left unattached (similar to a wellhead segment, in which the segment pipe is unattached so that flow can be directed to the surface). A pressure drop equation for the segment 402 is then replaced along the chord 408 with a control mode constraint equation. A segment 402 in the model of the well system 134 with an additional unattached chord 408 is called a boundary segment 400, as mentioned. Boundary segments 400 can be added to the well system 134 at any number of locations within a well, including branches (and tubing strings therein).

The mass conservation engine 210 and the energy conservation engine 212 account for mass and energy flowing in boundary segments 400, within the overall mass and energy conservation of the segment 402 and of the well system 134, which provides one of many example techniques for optimizing the well system 134.

In one implementation, a convergence engine 214 determines the most constraining limit in the boundary segments 400. That is, the wellhead control limit manager 236 first determines the well control mode, after which the boundary segments 400 control limit manager 240 determines the boundary segment 400 control modes that support the well control mode. The convergence engine 214 applies a heuristic model in which an acceptable solution is initially determined for the wellhead segment with precise control limits, but with approximate control limits assigned to the boundary segments 400, such that this process can be repeated with successive refinements to the boundary segment limits until these limits are either deemed to have been satisfied or violated, whereupon they are switched to their associated control modes.

In one implementation, when determination of the boundary segment control modes is subject to the prior or preferential determination of the main wellhead control mode, the boundary segments 400 may be considered as secondary wells while the main wellhead control point may be referred to as the primary well.

Solving heuristically may sometimes not work, because the presence of multiple boundary segments 400 within the well model 200 may (i) have multiple different solutions, or (ii) may not allow the overall well control mode to be satisfied due to the system being over-constrained.

In one implementation, the slack variable manager 222 is used to find an acceptable solution to well optimization, including multiple boundary segments 400 in addition to a wellhead segment. The slack variable manager 222 may apply modified slack variables, such as Watts slack variables, on control points—boundary and wellhead segments each of which may have a set of user specified flow rate/pressure limits—in order to determine which limit at each point is active or not (Watts, J. W., Fleming, G. C., Lu, Q., "Determination of Active Constraints in a Network", SPE 118877, presented at the 2009 SPE Reservoir Simulation Symposium, The Woodlands, Tex., Feb. 2-4, 2009). In one implementation, if a control limit is violated, the convergence engine 214 evaluates the worst offender and switches to that control mode. If the user has specified several limits at one control point in the system, e.g. oil production rate, water production rate, pressure limit, then a slack variable and multiplier can be assigned to each of these, even though all of these limits exist at the same control point.

In FIG. 3, the well system modeling platform 302 incorporates the multi-segment wellbore modeler 120 of FIG. 2. Thus, the well system modeling platform 302 has access to components such as the configuration engine 202, which provide the basic well model 200, and the source and sink terms that control the progress of a reservoir simulation. The configuration engine 202 can determine the flow contributions from each of the connecting reservoir grid cells while the well operates under a variety of possible control modes.

In the modeling platform 302, a measurement comparator 324 can compare results of the well model 200 calculation (including oil, water and gas flow rates, bottom hole and tubing head pressures) with measured values to validate the simulation model of the reservoir. Overall accuracy of a simulation can thus be determined by both the accuracy of the flow calculation in the reservoir grid and that of the wellbore modeler 202. As models become more complex, accuracy of the wellbore modeler 202 may determine the quality and usefulness of a simulation.

The well system modeling platform 302 can be used with comprehensive well models 200 that exist within next-generation parallel reservoir simulators. Such simulators can incorporate a general formulation approach, which handles global phase-component partitioning (334) allowing any number of phases and components, and in which any component can exist in any phase. A thermal mode selector 308 allows the model to run in either thermal or isothermal mode, the former having access to the thermal well manager 346 and a steam injection & production manager 310. The multi-segment wellbore modeler 120 enables the wellbore to be divided into segments for improved accuracy when simulating horizontal and multilateral wells. Such a unified well model 200 reduces to a conventional model when a single segment is used.

The multi-segment well model 200 using tubing strings and multiple control points presented herein can be part of a new scalable parallel commercial reservoir simulator 102. The field management controller 304 manages all wells in the current system. This field management controller 304 can be decoupled from surface and subsurface simulators with a defined interface 332.

A strategy engine 326 is able to provide operating strategies such as a list of instructions, in which a list of actions is tied to a triggering criterion and direct actions, as when the topology engine 224 modifies the well system 134 (opening a well, closing a completion, changing boundary conditions). The balancing engine 328 can provide optional balancing action. The strategy engine 326 or the balancing engine 328 may cause the flowing conditions of a well to be calculated many times with different constraint sets, classified for example, as "operating" (including all well constraints and those imposed from group/field operating strategies), "deliverable" (including the well's rate and pressure limits only), or "potential" (including the well's pressure limits only).

The field management controller 304 may include an isolated solver 330 that calls for several isolated solves of each well's flowing conditions in isolation. The flowing conditions can be solved under a variety of constraint values to allocate each well's share of the group and field targets, for example, before deciding on current operating constraint values and handing the isolated solves over to the simulator to perform a "coupled solve" of the complete well/reservoir system. Because of the high number of calls, and the usual demands placed on the well model 200 in a commercial simulator, the field management controller 304 can be designed for robustness and memory efficiency as well as maintainability and extensibility.

Well Model

A new well model 200 used and generated by the well system modeling platform 302 includes algorithmic and formulaic improvements over previous conventional commercial simulator well models. The well model 200 can be described with respect to aspects of its topology, formulation, and implementation. The well model 200 is also in communication via the interface 332 with external field management control 304, the reservoir simulator in use, and user data entry 320.

Well model formulation includes equations for multi-component mass and energy conservation in a multi-segment wellbore. Constraint handling is modelled: including special thermal well constraints, pseudo-pressure in a pseudo-pressure model 338, non-porous flow in a non-Darcy flow model 342, and heat transfer coefficients in heat models 336.

Implementation may cover the maintainable/extensible parallel code design. Data containers 322 are described, including the need for persistence, speed of access, and reusability. These have been designed for flexible storage of multiple solutions under different constraint sets, low parallel latency, back compatibility, and easy extensibility.

Linear solvers 316 and nonlinear solvers 314 provide solution of the well model equations, providing advances over previous well models. Improvements in separator design, including a more flexible stage structure, are discussed.

An account of the interface 318 of the well model 200 in the well system modeling platform 302 to the external world examines the exact responsibilities of the wellbore model in relation to field management control 304 and the reservoir simulator's nonlinear solver 314. Other interfaces 318 include those to a parallel linear solver, fluid property calculator, external data engine, and data validator.

Multi-Segment Well Design

Figure 5:
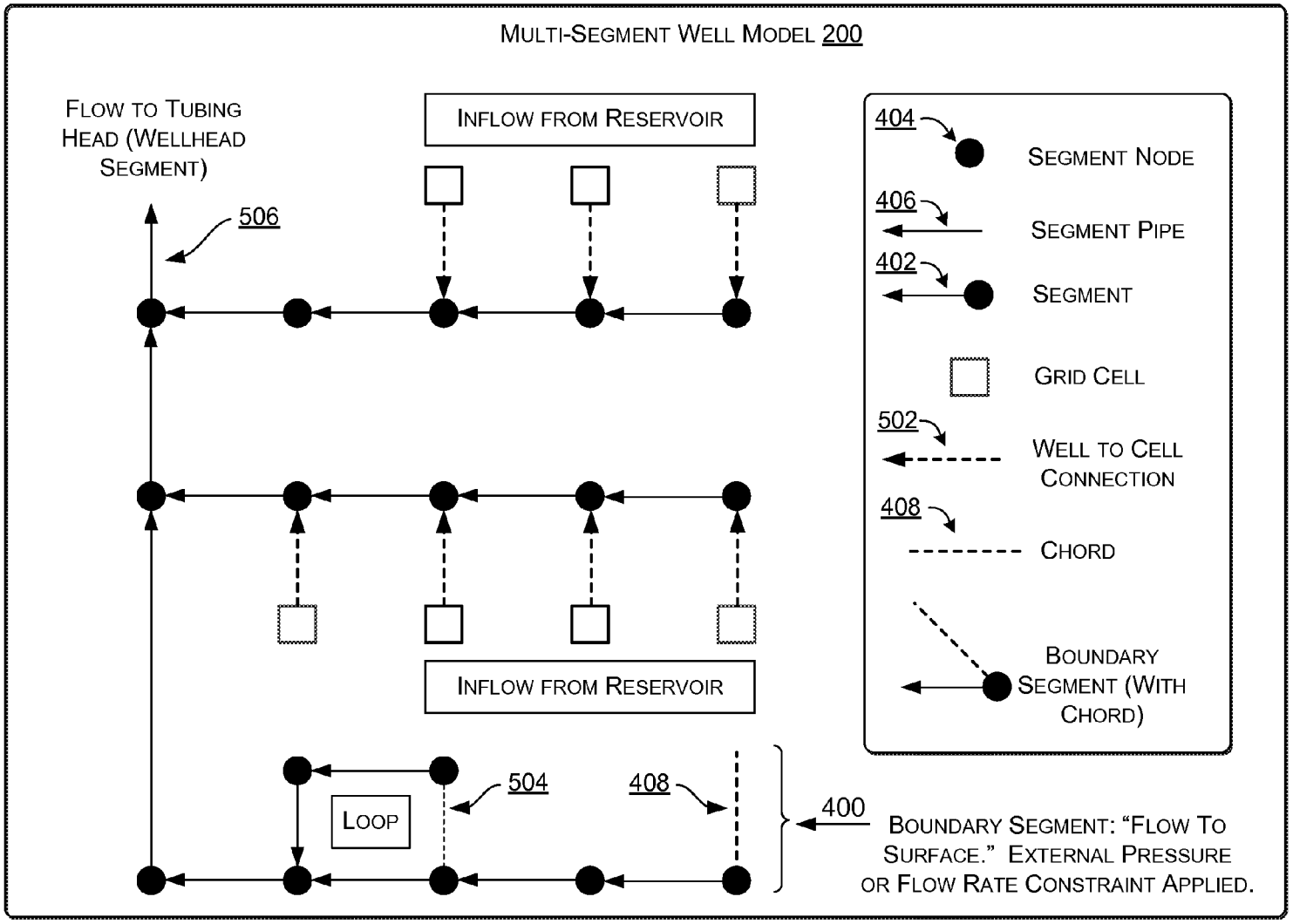
FIG. 5 is a diagram of an example segment tree of a well system modeled as a multi-segment well.

FIG. 5 shows a diagrammatic representation of a multi-segment well model 200, i.e., a "segment tree." In one implementation, the multi-segment well model 200 treats the well as a network of nodes 404 and pipes 406. A segment 402 includes a node 404 and a pipe 406 connecting the segment 402 to a neighboring segment's node 404, in the direction of the wellhead. Segments 402 that represent perforated lengths of the well may include one or more well-to-cell connections 502. Other segments 402, e.g., those representing unperforated lengths of tubing or specific devices, may include no well-to-cell connections.

The pressure drop along a segment pipe 406 may be determined by various models. In addition to a homogeneous flow model (with hydrostatic, friction and acceleration pressure-drop components) and the ability to use a flow performance "hydraulics" table, there are built-in models for sub-critical valves and several types of inflow control devices (ICD's).

As previously described, a segment 402 may have an additional pipe 408 called a chord 408. A chord 408 may either connect to another segment to form a closed loop or it may remain unconnected. A loop 504 is shown in FIG. 5. Loops 504 can be useful to model annulus flow in ICDs. A chord 408 may remain unattached to an adjoining segment, also illustrated in FIG. 5, and the segment is labeled a boundary segment 400. In this case, the unattached chord 408 can act as a conduit for flow to the surface at a fixed external pressure or with a specified rate constraint 218. If it is desirable to use the chord 408 to model flow to the surface, a flow performance hydraulics table may be assigned as the pressure-drop model along this pipe 408. If several pressure and rate constraints 218 are assigned to this unattached chord 408, then the chord 408 effectively acts as a downhole control mode where the constraint will automatically switch if one or more of the assigned constraints are violated.

Figure 6:
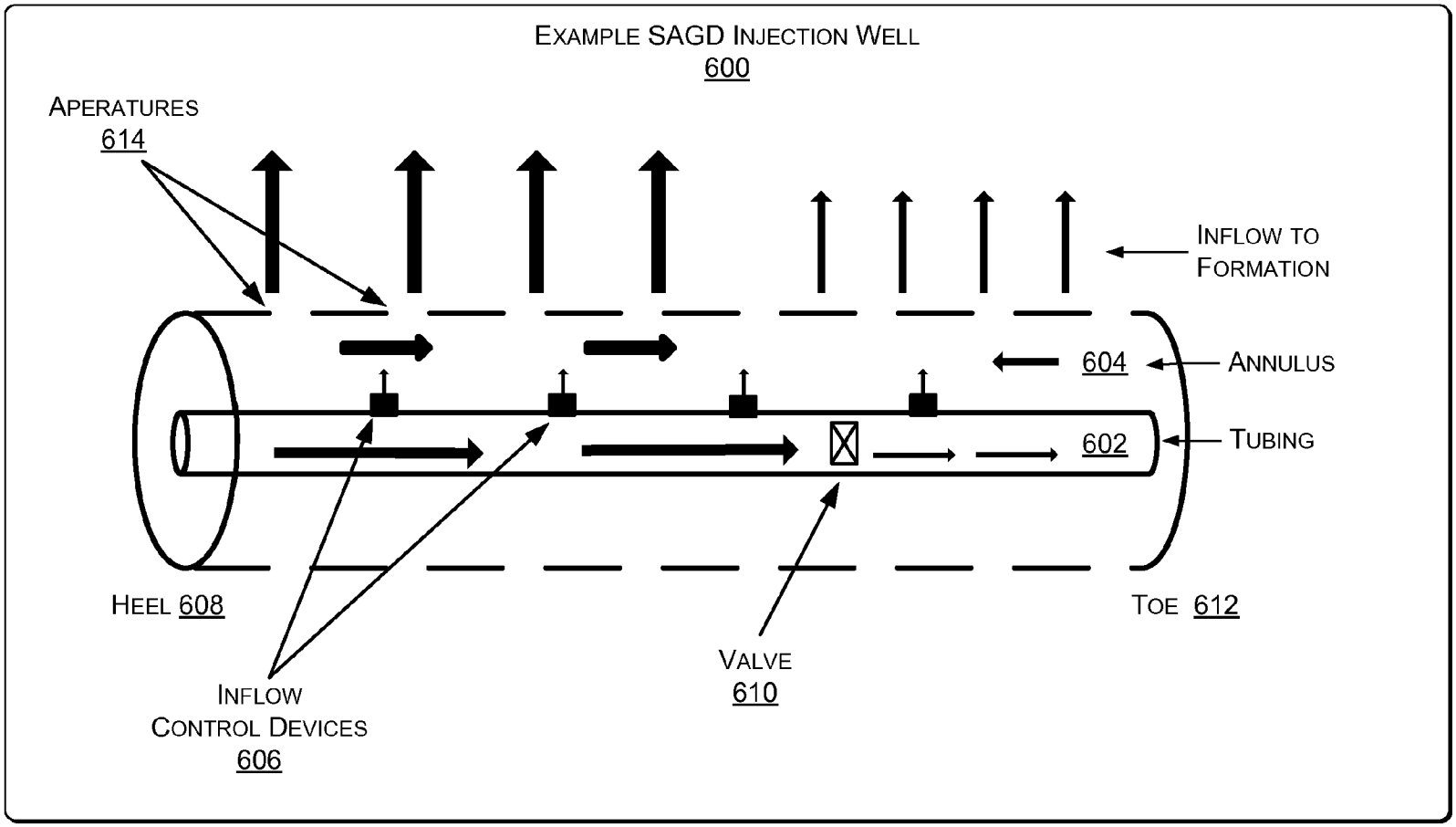
FIG. 6 is a diagram of an example multi-string injection well.

FIG. 6 also shows a typical steam assisted gravity drainage (SAGD) steam injection well 600 with an inner tubing 602 and outer annulus 604. FIG. 6 shows Inflow Control Devices (ICD's) 606 inserted into the SAGD steam injection well 600. Enhanced flow to the outer annulus 604 occurs nearer to the heel 608, and a device, such as a sub-critical valve 610 in the inner tubing 602 partially blocks tubular flow toward the toe 612. There are static apertures 614 of various diameters in the tubing allowing multiple looped flowpaths 504 between the tubing 602 and the annulus 604. A variation in steam flow rates is illustrated in FIG. 6 by the arrows. In the startup phase of the SAGD process, steam circulates through the inner tubing 602, back along the outer annulus 604 and returns to the surface to heat the reservoir around the well by conduction. This steam injection well 600 can be modeled using a boundary segment 400 as discussed above in which both rate and pressure constraints 218 are set.

Figure 7:
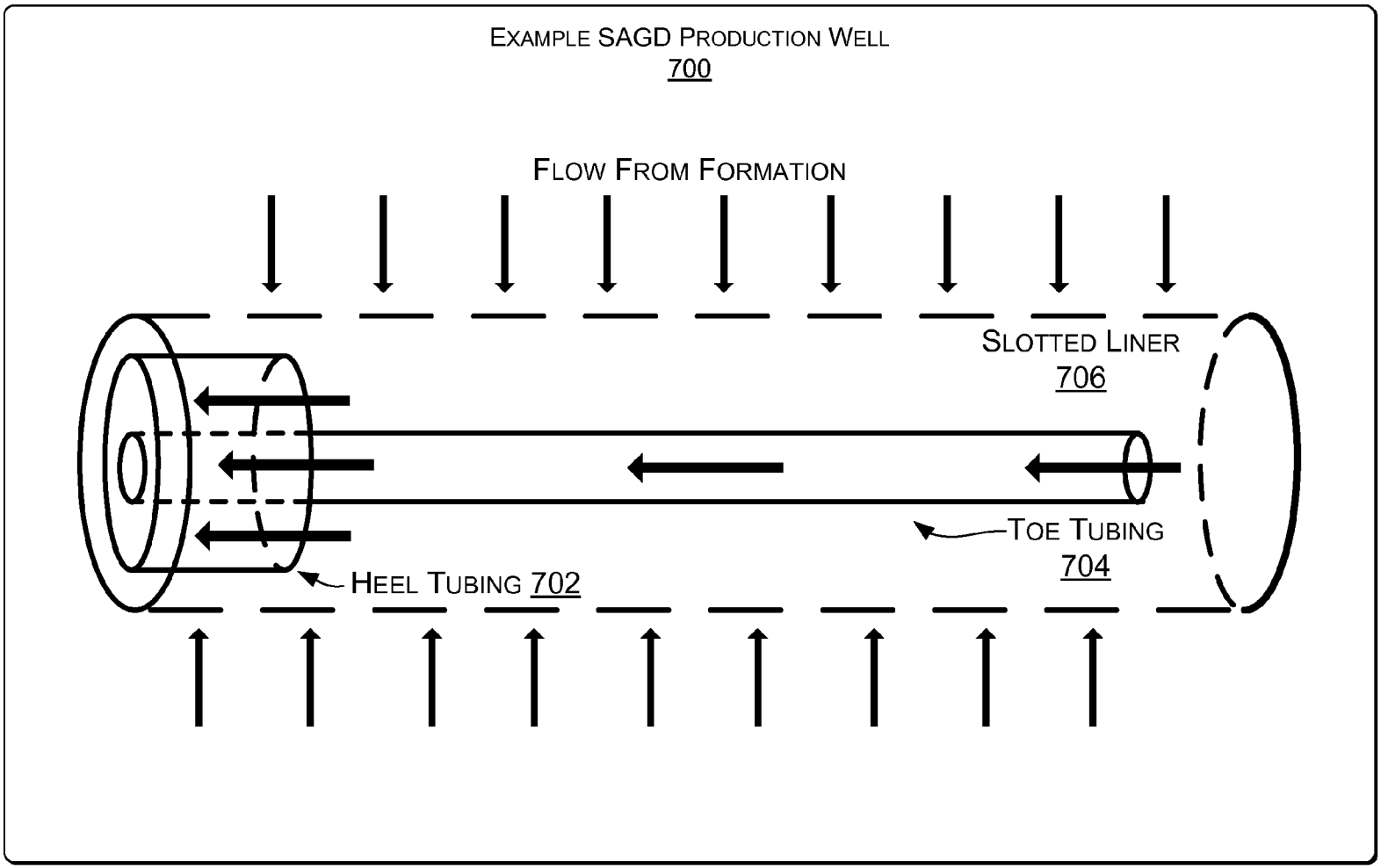
FIG. 7 is a diagram of an example multi-string production well.

FIG. 7 shows a typical SAGD production well 700 with concentric outer heel tubing 702 and inner toe tubing 704 within a slotted liner 706. The produced fluid flows from the formation into the heel tubing 702 and toe tubing 704 via the slotted liner 706 and subsequently to the surface. This well 700 is modeled with both rate and pressure constraints set with the heel tubing 702 designated as the wellhead and the boundary segment 400 designated as the toe tubing 704. The boundary segment 400 can also be referred to as a "secondary well."

Figure 8:
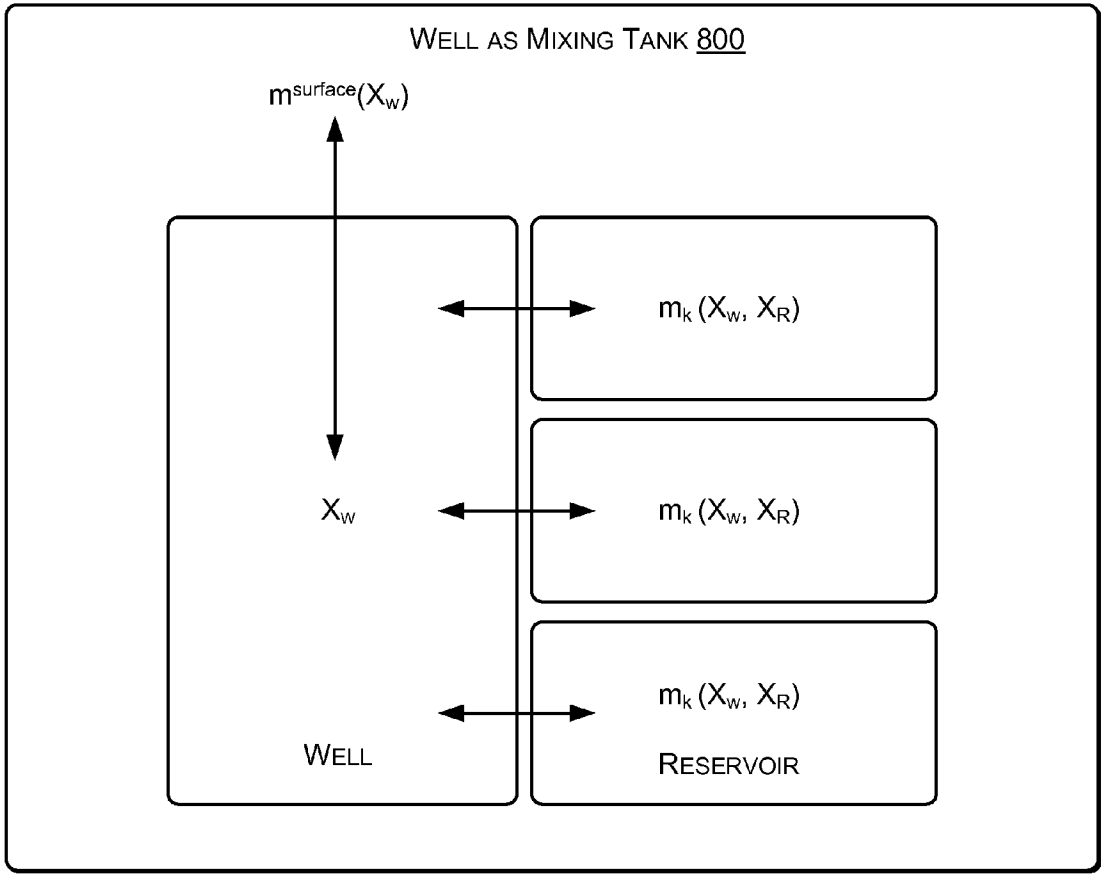
FIG. 8 is a diagram of a model of a single segment well.

As shown in FIG. 8, a well can be modeled as a perfect mixing tank 800. Thus, a conventional well within a larger system may be modeled as a single segment 402 of a multi-segment well system 200. The location of the segment node 404 can be modeled at a suitable depth within the formation. However, the node depth need not be the same as the bottom hole reference depth since the well model formulation will transform between the bottom hole pressure (BHP) and the node pressure using a hydrostatic pressure head.

A number of new multi-segment features are available in the example well system modeling platform 302 when compared with previous simulators. These include (i) a "bottom hole" segment, responsible for constraints on bottom hole pressure, which as just described, can be placed anywhere in the segment tree rather than at the point of least measured depth; (ii) the segment nodes 404 and pipes 406 are treated as separate items allowing for flexible handling of chords 408 and devices (606, 610) and (iii) the ability to allow gas lift, circulation, and downhole control modes within the segment tree has been considerably expanded.

Equation Formulations

The example well system modeling platform 302 offers improved robustness through use of new equation formulations:

Nomenclature:

$A_{HT}$=contact area for conductive heat transfer h=segment fluid molar enthalpy $H_T$=overall heat transfer coefficient $m_c^{pipe}$=molar flow rate of component c in a segment pipe $m_c^{surf}$=molar flow rate of component c from the well to surface $m_{c,k}$=molar flow rate of component c from the formation into the well through a well-to-cell connection k $m_{c,s}$=molar flow rate of component c into the segment from segments s whose pipes connect to this segment's node $M_c^{t+\Delta t}$=total moles of component c in the segment at time t+Δt $M_T^{t+\Delta t}$=total moles in the segment at time t+Δt $m_T^{pipe}$=total molar flow rate along the segment pipe $m_T^{prd}$=total molar flow rate into the segment pipe $m_{T,k}$=total molar flow rate from the formation into the well through a well-to-cell connection k $m_{T,s}$=total molar inflow rate from adjoining segments $N_{tc}$=total number of components including water P=segment pressure $q_{enth}^{pipe}=m_T^{pipe}h_s$=enthalpy along the segment pipe where $h_S$ is the fluid enthalpy in the upstream segment node $q_{enth,k}$=inflow of enthalpy from the formation through well-to-cell connections $q_{heat,ext}$=conductive heat exchange to an external environment (e.g. overburden) at a specified fixed temperature $q_{heat,k}$=conductive heat exchange with the formation $q_{heat,s}$=conductive heat exchange from other segments $q_{enth,s}$=enthalpy flow into the segment from other segments s whose pipes connect to this segment's node $R_{cs}$, $R_{cd}$=component c conservation residual for 'standard' and 'diagonal' formulations→0.0 upon time step convergence $R_{es}$, $R_{ed}$=total energy conservation residual for 'standard' and 'diagonal' formulations→0.0 upon time step convergence $R_T$=total molar conservation residual→0.0 upon time step convergence $T_{seg}$=segment temperature $T_{s,k,ex}$=the temperature of a target segment or completion grid block or external fixed temperature, $V_{seg}$=segment volume $X_R$=reservoir primary variables $X_W$=well primary variables (P, $m_T$, Z, H)

$z_c$=segment global mole fraction of component c $\Delta E=E^{t-\Delta t}-E^t$=change in segment internal energy over the time step $\Delta M_c$=the increase in the number of moles of component c contained in the wellbore over the time step Δt Δt=time step size In one implementation, component and total molar balance equations within a well segment 402 can be written in residual form as in Equation (1) and Equation (2):

$$m_c^{pipe} - \sum_s m_{c,s} - \sum_k m_{c,k} + \frac{\Delta M_c}{\Delta t} = R_{cs},\ c = 1, \ldots N_{tc} \tag{1}$$

$$m_T^{pipe} - \sum_s m_{T,s} - \sum_k \sum_c m_{c,k} + \frac{1}{\Delta t}\sum_c \Delta M_c = R_T \tag{2}$$

where $m_T^{pipe}$ the total molar flow rate along the segment pipe, positive in the direction towards the wellhead; $m_T^{pipe}=m_t^{pipe}z_c$ the component molar flow rate along the segment pipe, where $z_c$ is the component mole fraction in the upstream segment node; $m_{T,s}$ is the total molar flow rate into the segment (negative for outflow from the segment) from other segments s whose pipes connect to this segment's node; it is equal to $m_T^{pipe}$ of the connecting segment s; $m_{c,s}$ is the component molar flow rate into the segment (negative for outflow from the segment) from other segments s whose pipes connect to this segment's node; it is equal to $m_T^{pipe}$ of the connecting segment s, multiplied by the $z_c$ of the segment node upstream to the flow in the pipe; $m_{c,k}$ is the component molar flow rate from the reservoir into the well through the well-to-cell connection k (negative for injection into the reservoir); $\Delta M_c$ is the increase in component moles contained within the volume of the segment over the time step $\Delta t$.

The mass accumulation terms enable the modeling of transient phenomena in the wellbore, but can be turned off by setting the segment volumes to zero.

In addition, an energy conservation equation includes enthalpy inflow from, and outflow to, neighboring segments and extra terms for conductive heat transfer, as in Equation (3):

$$q_{enith}^{pipe} - \sum_s q_{enth,s} - \sum_k q_{enth,k} - \sum_s q_{heat,s} - \sum_k q_{heat,k} - q_{heat,ext} + \frac{\Delta E}{\Delta t} = R_{es} \tag{3}$$

Equation (1) can be rewritten to distinguish between flows towards the wellhead denoted with a superscript prd (production), and flows away from the wellhead denoted with a superscript inj (injection). It is evident that the flow in the segment's pipe 406 can only be in one direction at once, so one of the terms $m_c^{prd}$ and $m_c^{inj}$ will be zero. The summations are summed over the range of producing and injecting flows from/to adjacent segments s and through well-to-cell connections k 502. Flows in the direction away from the wellhead are negative, as in Equation (4):

$$m_c^{prd} + m_c^{inj} - \sum_s^{prd} m_{c,s} - \sum_s^{inj} m_{c,s} - \sum_k^{prd} m_{c,k} - \sum_k^{inj} m_{c,k} + \frac{M_c^{t+\Delta t} - M_c^t}{\Delta t} = 0 \tag{4}$$

The following terms in equation (4) are proportional to the segment's implicit component mole fraction variable $z_c$, shown in Equations (5):

$$\begin{aligned} m_c^{prd} &= z_c m_T^{prd} \\ \sum_k^{inj} m_{c,k} &= z_c \sum_k^{inj} m_{T,k} \\ \sum_s^{inj} m_{c,s} &= z_c \sum_s^{inj} m_{T,s} \\ M_c^{t+\Delta t} &= z_c M_T^{t+\Delta t} \end{aligned} \tag{5}$$

Substituting Equations (5) into (4) gives Equation (6):

$$z_c\left(m_T^{prd} - \sum_s^{inj} m_{T,s} - \sum_k^{inj} m_{T,k} + \frac{M_T^{t+\Delta t}}{\Delta t}\right) + \tag{6}$$

-continued $$m_c^{inj} - \sum_s^{prd} m_{c,s} - \sum_k^{prd} m_{c,k} - \frac{M_c^t}{\Delta t} = 0$$

The total mass balance Equation (2) can also be written in a form similar to Equation (4), as in Equation (7):

$$m_T^{prd} + m_T^{inj} - \sum_s^{prd} m_{T,s} - \sum_s^{inj} m_{T,s} - \sum_k^{prd} m_{T,k} - \sum_k^{inj} m_{T,k} + \frac{M_T^{t+\Delta t} - M_T^t}{\Delta t} = 0 \tag{7}$$

and with some rearrangement, gives Equation (8):

$$m_T^{prd} - \sum_s^{inj} m_{T,s} - \sum_k^{inj} m_{T,k} + \frac{M_T^{t+\Delta t}}{\Delta t} = -m_T^{inj} + \sum_s^{prd} m_{T,s} + \sum_k^{prd} m_{T,k} + \frac{M_T^t}{\Delta t} \tag{8}$$

Using equation (8) to replace the terms inside the brackets of Equation (6) yields Equation (9):

$$z_c - \left(\frac{-m_c^{inj} + \sum_s^{prd} m_{c,s} + \sum_k^{prd} m_{c,k} + \frac{M_c^t}{\Delta t}}{-m_T^{inj} + \sum_s^{prd} m_{T,s} + \sum_k^{prd} m_{T,k} + \frac{M_T^t}{\Delta t}}\right) = R_{cd} \tag{9}$$

The energy balance equation can also be written in an analogous fashion, as in Equation (10):

$$h_W - \left(\frac{-q_{enth}^{inj} + \sum_s^{prd} q_{enth,s} + \sum_k^{prd} q_{emth,k} + \sum_{k-heat} q_{heat,k} + \frac{E^t + PV_{seg}}{\Delta t}}{-m_T^{inj} + \sum_s^{prd} m_{T,s} + \sum_k^{prd} m_{T,k} + \frac{M_T^t}{\Delta t}}\right) = R_{ed} \tag{10}$$

The terms in the brackets that account for the net conductive heat inflow and an additional PV term added to the internal energy in the numerator are worth noting (a conversion constant psi·ft$^3$→BTU is understood).

The components Equation (9) and energy Equation (10) can be solved in conjunction with a total molar balance Equation (2) to achieve conservation of each component and all components and to achieve conservation of energy.

The formulation in Equation (9) and Equation (10) has different convergence properties compared to the more "standard" inflow/outflow formulation expressed in Equation (1) and Equation (3). In particular, the Jacobian matrix is more diagonally dominant in the components Equation (9) and the global component mole fractions z often converge more quickly than the pressure and total molar rate variables. This "diagonal" formulation can provide a reduction in the number of Newton iterations to converge the well model 200 in some cases, compared to the "standard" formulation, in which convergence tends to be more even across all variables. The well model 200 described herein uses both formulations.

The set of $N_{ic}+3$ independent variables for both formulations are the same, these being (P, $m_T^{pipe}$, $z_c$, h). The alignment of variables to the Equations is:

P aligns with the constraint equation, $m_T^{pipe}$ aligns with the mass balance Equation (2) for "diagonal" and a z constraint $$\left(\sum_c z_c = 1\right)$$

for "standard,"

$z_c$ aligns with the corresponding component c residual Equation (9) for "diagonal" and Equation (1) for "standard", h aligns with the energy balance Equation (10) for "diagonal" and Equation (3) for "standard."

If a segment chord 408 is present, there is one extra variable, $m_T^{chord}$, which is aligned with the chord constraint equation.

The use of multiple formulations is new with this well model 200 as compared to previous well models. This feature allows both enhanced robustness and flexibility and is also important when incorporating different equation sets, for example those for the Darcy segments discussed below.

Well, Segment, and Boundary Segment Constraints

In FIG. 5, the segment in the upper left labeled "Flow to Tubing Head" is the designated "tubing head" or wellhead segment 506, which is responsible for constraints on the flow rate to the surface and tubing head pressure. A "bottom hole" segment is responsible for constraints on bottom hole pressure. The tubing head segment 506 is the one with least measured depth while the bottom hole segment may be placed at the lowest depth or elsewhere in the segment tree.

Within the segment that includes the acting constraint on the well, a constraint equation is solved in place of the pressure drop equation. For one or more other segments, an equation can be applied that describes pressure drop across the segment pipe 406 as a function of the segment's solution variables and, additionally, across the segment chord 408 if the chord 408 is attached to an adjoining segment. If a homogeneous pipeflow model is selected, the pressure drop is modeled as the sum of the hydrostatic, friction and acceleration heads. However, if the segment pipe 406 has a device assigned to it, e.g., a sub-critical valve 610, then the pressure drop is calculated using a specific model of that device.

Other options include the ability to specify (i) a hydraulics table, which is a multi-variable correlated pressure drop table with parameters including phase flow rates, phase ratios, etc., wherein the user may "design" a hydraulics table to model special devices, flow to surface, or special flow paths; (ii) a drift-flux model where the individual phases may flow with different velocities; and (iii) a Darcy model for phase pressure drop with additional independent variables for each phase molar rate. Segments with unattached chords 408, i.e., boundary segments 400, may also have a set of pressure and rate limits 218 assigned.

In thermal simulations the well constraint set may also include (i) a "steam trap" constraint which forces segment pressures or temperatures to remain sub-cooled by a specified offset; and (ii) a steam production constraint which limits production based on inflowing water vapor.

Improvements in constraint handling over previous conventional simulators include (i) the ability to specify different pressure drop models and pressure drop components to any segment in the tree; (ii) the ability to place any number of "boundary segments" within the segment tree—this creates some ambiguity as to which control point provides overall well control, which the multi-segment wellbore modeler 120 solves, and (iii) the ability to specify segments that model pipe flow, fully coupled to segments that model Darcy flow in porous media. These latter segments modeled by Darcy flow may apply to flow in fractures or surrounding formation.

Separators

In one implementation, the role of the separator model 344 is to calculate surface phase volumes of a given reservoir fluid or wellstream. The separator model 344 is used in the calculation of fluid-in-place reports for the reservoir and its regions and also to calculate surface volume rates for wells and groups.

Figure 9:
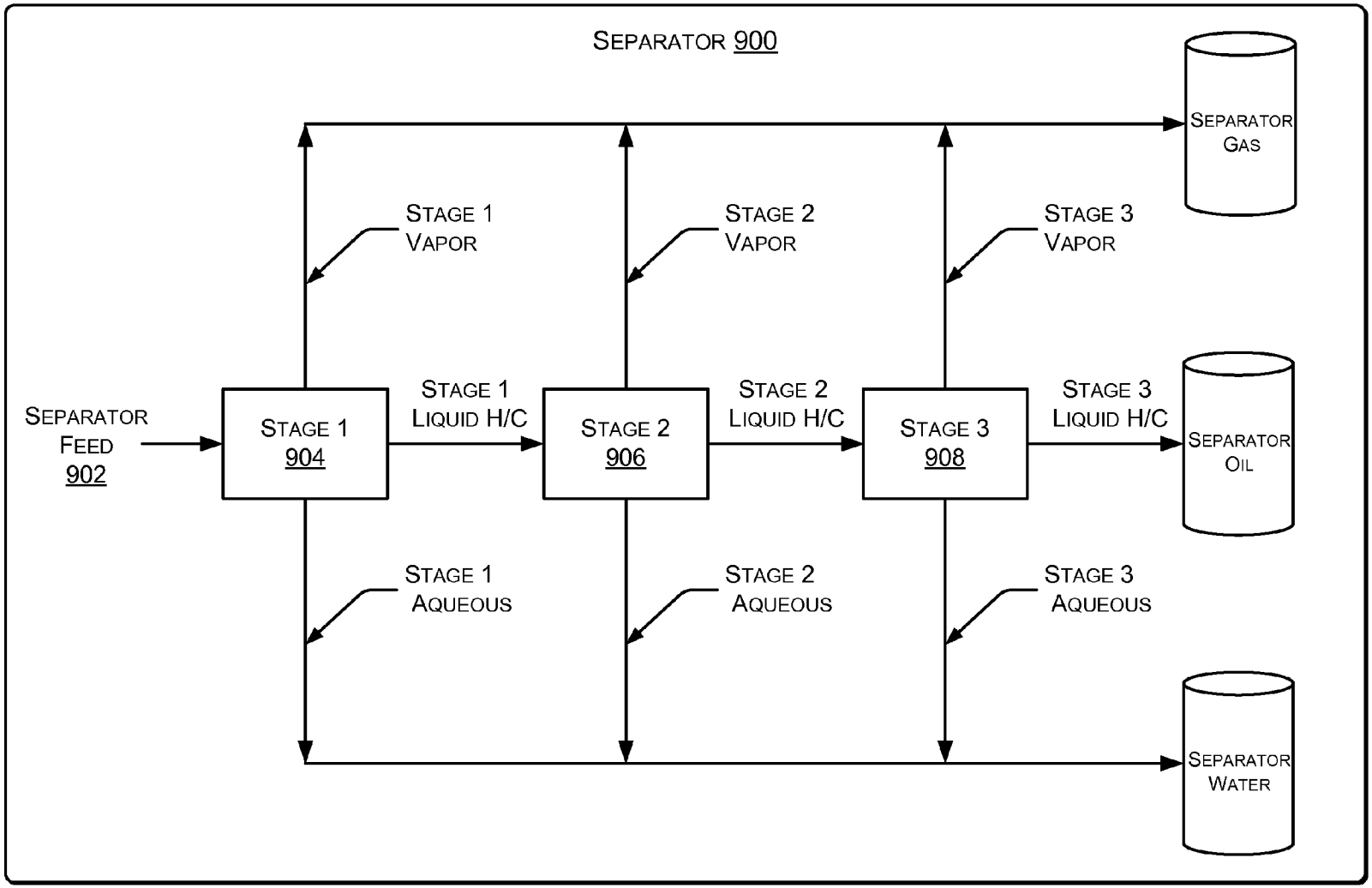
FIG. 9 is a diagram of an example phase separator.

FIG. 9 shows an example phase separator 900. The example phase separator 900 includes a chain of stages at different temperatures and pressures. The separator feed 902 (expressed as component moles or molar rates) are flashed to thermodynamic equilibrium at the first stage 904 in the separator chain, and the outlet stream for each of the equilibrated phases is then sent to subsequent stages (906, 908) in the chain or added to the overall separator outlet for that phase. Fluid from any phase outlet of any stage can be split and sent to different downstream stages. This split may be based on a volume fraction or volume rate for each phase outlet.

The phase separator 900 may be based on the phase-component partitioning model 334 and may be generic in the sense that the phase separator 900 can model or control, without loss of generality, any number of phases including natural gas liquids (NGLs) and solvents. Within any stage, the flash calculation can be based on a black oil fluid model, an equation-of-state compositional fluid model, a thermal fluid model, a gas plant table, or a K-value table.

The separator model 344 has more flexibility than those provided in conventional simulators in allowing output from any stage to be split and sent to different downstream stages. It is also more generic, allowing any phase to be split off.

Modeled Well Options

The modeling enhancement engine 306 may include various models by which a well system 134 with tubing strings and multiple control points may be improved.

Heater Model

In one implementation, heat injection wells may be modeled and improved according to one or more heat models 336. Heaters are operationally constrained by a maximum energy output rate, $e_T \le e_{T,max}$, and a maximum heater temperature, $T_h \le E_{h,max}$. Heater wells may be completed in multiple grid cells, so that the total energy output rate from a heater is given by the sum over all heater-to-cell connections, $$e_T = \sum_k e_k,$$

with the heat injection rate at a connection being given by $e_k = I_{E,k}(T_h - T_k)$ where $I_{E,k}$ is the connection heat transfer coefficient and $T_k$ the connected reservoir cell temperature.

The heater numerical solution can be obtained by first calculating the total energy with the heater operating at maximum temperature, $e_T(T_h=T_{h,max})$. If this exceeds the allowable maximum, $e_{T,max}$ then the heater temperature can be determined directly from Equation (11):

$$T_h = \left(e_{T,max} + \sum_k I_{E,k} T_k\right) / \sum_k I_{E,k} \tag{11}$$

From the resulting value of the heater temperature, $T_k$, the energy injection into each connected cell can be calculated.

The example heat models 336 differ from, and are more physically realistic than, that implemented in some conventional simulators in which the total energy constraint applies only to each cell connection.

Pseudo-Pressure Model

Inflow into wells with a large connection drawdown is not accurately represented by component mobilities calculated from cell average conditions as used in the standard inflow performance relation. For gas condensate producers with high drawdown, the gas flow rate may also be significantly over-predicted since the inflow equation does not take account of condensate drop-out or blockage that occurs if the gas pressure near the well falls below its dew-point pressure.

To compensate for this, a steady-state pseudo-pressure model 338 can be used in which the component molar inflow rate is modified by a blocking factor 340, of the form shown in Equation (12):

$$F_B = \frac{1}{\gamma_T \Delta P_k} \int_{P_{W,k}}^{P_{cell}} \lambda_T \, dP \tag{12}$$

where $\lambda_T=k_{r,o}\rho_o/\mu_o+k_{r,g}\rho_g/\mu_g$ is the total generalized molar mobility, and $\Delta P_k=P_{cell}-P_{W,k}$ is the well connection drawdown: the difference between cell pressure and connection pressure, hydrostatically corrected for depth differences.

The blocking factor 340 can be modeled with an explicit calculation at the beginning of a time step using the well drawdown and reservoir conditions from the previous time step. Explicit modeling can suffer from instability, however, and so to protect against oscillatory solutions, in one implementation, an option is provided to determine the blocking factor 340 by a weighted average of $F_{B,new}$ as calculated from Equation (12) and the value from the previous time step, $F_B=(1-\beta)F_{B,old}+\beta F_{B,new}$. The weighting factor, β, may be user-supplied, with a value of unity representing the undamped situation.

A semi-implicit model may also be offered, in which the blocking factor 340 is recalculated whenever the connection cell properties or drawdown is updated. To efficiently evaluate the expensive integral in Equation (12) for a particular connection, a look-up table of pressure versus the pseudo-pressure function $$\Phi(P) = \int_{P_{min}}^{P} \lambda_T \, dP$$

is first formed for an appropriately chosen $P_{min}$, so that $$\int_{P_{W_k}}^{P_{cell}} \lambda_T \, dP$$

can be evaluated quickly as $\Phi(P_{cell})-\Phi(P_{W_k})$.

While the denominator of Equation (12), $\lambda_T\Delta P_k$, is recalculated using updated connection cell properties, the pseudo-pressure function is only updated with new drawdown limits. If the inflow region deviates significantly from steady-state, this can lead to extreme blocking factors 340, which can be ameliorated by updating the look-up table more frequently. The damping scheme used in the explicit model is also offered in a semi-implicit model.

The pseudo-pressure model 338 implementation in the example multi-segment well model 200 offers a unified explicit and semi-implicit pseudo-pressure treatment for generalized pseudo-pressure models, as above, as well as restricted single phase models. Some previous implementations offered these features separately. However it is useful to be able to model all aspects together to customize the balance of accuracy, speed and convergence on any given problem.

Conductive Heat Transfer

In one implementation, conductive heat transfer is modeled by one of the heat models 336 and can take place across a number of heat transfer connections: from a segment 402 to the reservoir grid, to another segment (for tubing-annulus heat transfer, or conduction along the well) or to a specified fixed external temperature. The heat transfer rate, $Q_{ht}$, to/from the segment 402 can be represented by Equation (13):

$$Q_{ht}=A_{HT}\cdot(T_{seg}-T_{s,k,ex})\cdot H_T \tag{13}$$

This facility includes the ability to specify multiple contact areas $A_{HT}$ for a single segment or these areas may span segments. Some further discussion of conductive heat transfer in this well model 200 can be found in Stone et al. 2010 and in an earlier simulator, Stone et al. 2001.

Non-Darcy Flow Model

A non-Darcy flow model 342 for non-porous flow may be included in the modeling enhancement engine 306. A Forchheimer correction is available to account for high velocity gas inflow that may occur in high permeability regions. It is compatible with pseudo-pressure (gas condensate) and black-oil solvent calculations. The implementation in the well model 200 is fully implicit, in contrast to earlier conventional simulators, in which the implementation might have been semi-implicit.

Other Enhancements

The well system modeling platform 302 may contain other features that enhance operation in a multi-segment and multi-connection-point modeling environment.

Data Containers

All non-temporary data associated with a well can be functionally split as follows:

Well data

Segment data

Connection data

Connected cell data

Each of the first three types of data above may be further split into:

Specification data that remains static during well calculations

Dynamic data that changes with the well solution.

Data containers 322 may be underpinned by a base class that provides parallel communications, serialization (reading and writing restarts) and general data manipulation techniques. Data of a given type may be stored as a single vector, making parallel communications as efficient as possible.

Container property dimensions reflect dependencies of that property. Certain properties may be dependent on the phase and these have a dimension in the data containers 322 equal to the number of phases. Thereby, the containers 322 can easily be adjusted to the number of phases currently being modeled in the simulation. There does not need to be an explicit limitation to oil, water, gas, or solvent phases as such reduces the flexibility of the container 322. A property, such as a component mole fraction in a phase, has multiple dimensions (e.g., component and phase numbers, in this case). Another container dimension may be used to allow the storage of three different types of well solutions: one with potential constraints in place, one with deliverability constraints in place and one with operating constraints in place, as described above. This ensures that a well calculation starts from the well solution state at the end of the last calculation for this solution type. This can greatly aid the well system modeling platform 302 in terms of solution stability and minimizes the number of iterations needed to solve the well model 200. Additional dimensions can include time level, well type, and data type.

In one implementation, only dynamic containers 322 are serialized (written to and read from the restart files); the specification containers are loaded from the input data schema when the simulation is restarted. Any changes in the input data schema in a new version of the simulator will not restrict the use of a restart written by an earlier version of the simulator. The well system modeling platform 302 also maintains backwards restart compatibility in the sense that even if the dynamic data container sizes change between versions, a later version of the simulator can still run from a well restart written from an earlier version.

Memory can be saved in the well system modeling platform 302 by making extensive use of workspaces that are reused by all wells. The main well workspace holds segment quantities and is dynamically resized when necessary and grows to accommodate the well with the largest number of segments. Unlike the data containers 322, these are not intended for persistent data and are designed to hold the intermediate results of the property calculations, well Jacobian construction, and linear solutions. To enforce the temporary nature of the data in the segment workspace and encourage good coding practice, all elements are set to zero before each well calculation. Then before the well model Newton iteration loop, data is loaded into the workspace from the dynamic segment data container 322. After convergence, data used to persist between well calculations is extracted from the workspace and stored in dynamic segment and well data containers 322.

In one implementation, the data containers 322 in this well system modeling platform 302 provide (i) a higher degree of robustness including latency, (ii) more maintainability and extensibility, and (iii) more configurability and memory efficiency.

Nonlinear Solver

Before entering the nonlinear solver 314, a series of basic pre-solve checks can be performed to ensure that the target constraint 218 imposed on the well is physically achievable given the current state of the well and reservoir. In one implementation, these checks are as follows:

For wells using an explicit calculation of the hydrostatic head, a check is made to see whether any well-to-cell connection 502 can flow in the correct direction when the well is operating at its bottom hole pressure (BHP) limit. If this is not the case, the well is temporarily closed for the remainder of the current reservoir Newton iteration. Such a well is re-opened at the start of the next reservoir Newton iteration to check again whether it can flow at its BHP limit. If the well is repeatedly closed because it cannot flow, it will be permanently shut. This check cannot be made for wells using an implicit calculation of the head, which includes all multi-segment wells.

For wells on a rate control, the latest inflow performance relationship (IPR) is used to estimate the corresponding BHP. If this violates the BHP limit, the well is switched to BHP control.

For wells on BHP control, the IPR is used to determine the overall molar flow rate of the well. If this is in the wrong direction (i.e., if a production well has a negative overall molar rate or an injector has a positive rate), the well is temporarily closed for the remainder of the current reservoir Newton iteration. Such a well is re-opened at the start of the next reservoir Newton iteration to check again whether it can flow at its BHP limit. The IPR is calculated using the latest well and reservoir conditions, but with the cross-flow pattern frozen to that recorded at the end of the last converged time step.

Following this, the main Newton loop is entered. The set of residual equations for the reservoir and the wells can be written as Equation (14):

$$R(X)=0 \tag{14}$$

where X represents the combined set of solution variables in the wells and the reservoir grid cells. These nonlinear equations are solved by Newton iteration, as in Equation (15):

$$R(X-x)=R(X)-\frac{\partial R}{\partial X}x=0 \tag{15}$$

where x represents the increment to the solution X over the iteration. At each Newton iteration, therefore, a matrix equation of the form Equation (16):

$$J\cdot x=R(X) \tag{16}$$

can be solved. This matrix equation can be partitioned to separate the well and reservoir residual equations, as in Equation (17):

$$\begin{bmatrix} B & H \\ G & A \end{bmatrix}\cdot\begin{bmatrix} X_W \\ X_R \end{bmatrix}=\begin{bmatrix} R_W \\ R_R \end{bmatrix} \tag{17}$$

Wells are first solved to convergence, then using a Schur complement form of Equation (17), the reservoir variables $X_R$ are solved. In practice, the Schur complement of the matrix is never calculated explicitly. Instead, the residuals calculated during the iterative process used to solve the reservoir equations are modified to take account of the well terms. This avoids the need to store additional terms arising from fill in the Schur complement.

Linear Solvers

A set of direct and iterative linear solvers 316 is available in the well system modeling platform 302. If the segment tree is "dendrite," i.e., a segment 402 can have only one outlet but numerous inlets, then a direct modified Thomas algorithm is selected by default. If loops 504 or boundary segments 400 are specified, then the topology engine 224 no longer preserves the dendrite topology and a general block LU decomposition direct solver is selected based on the Grout algorithm. A GMRES iterative solver is also available with a range of possible preconditioning methods such as ILU(k) and CPR. This is the same linear solver 316 used for the reservoir equations and is capable of solving linear systems distributed across parallel processors. For multi-segment wells with a large number of segments 402, this allows for the possibility of very general parallel distribution of the well equations. The iterative nature of the solver 316 also provides the possibility of solving multi-segment wells with loops 504 using an ILU(k) preconditioned iterative method; an approach which limits the fill resulting from the non-dendrite nature of the linear system in these cases.

Both the iterative and direct linear solvers 316 in this well model 200 are an improvement over some previous simulators. The direct solver 316 has been expanded to allow a block LU decomposition when solving a non-dendrite tree topology. The iterative solver has improved preconditioning and parallel processing capabilities.

Code Design Features

In one implementation the well system modeling platform 302 has some code design features:

- coded in C++
- polymorphism is minimized, e.g., minimal templating
- data containers 322 as discussed above
- each well, data container 322 has its own class
- the Newton well engine code design is strongly algorithmic and procedural
- the Newton well engine code is completely coded in general formulation, i.e., over all components, phases—reference to individual components and phases is only made in the interface 318 to external property calculations
- key items of the Newton loop, i.e., property calculation, Jacobian setup, linear solve, variable update, have separate controllers (supervisors)
- heavy commenting and multiple commenting levels—strict coding rules
- extensive well debug 348 arranged in independently configurable categories
- strong naming conventions for persistent data
- code re-use can be maximized, e.g., the final G, B and H matrices are constructed with the same methods used during nonlinear solution of the well equations. Some interfaces 318 between the well model 200 and the external world are: (i) data input (schema), (ii) reservoir linear and nonlinear solver, (iii) PVT and SCAL (relative permeability) property calculations, and (iv) field management 304. Several of these can include a property map to ensure that data layout is consistent between the well and external data containers 322. Care is taken to isolate dependencies to all external classes.

The well system modeling platform 302 and well model design are an enhancement over conventional well model designers and designs. The isolation from data input, the reservoir linear solver 316 and nonlinear solver 314, property calculations and field management 304 allows greater flexibility to design well-specific data structures, features, debug facilities, linear solvers 316 and nonlinear solvers 314.

Parallel Processing

The parallel processing manager 312 automatically partitions and distributes the reservoir grid to the processors in a manner that minimizes communication while also balancing workload. Each process owns the cells it has been assigned but also maintains a list of "halo" cells on other processors that are connected to it across the boundary of its partition. The solution in these cells is kept synchronized during the time-stepping algorithm and allows each process to evaluate its contribution to the global Jacobian matrix for modeling.

Compared to the reservoir, the well linear system is typically orders of magnitude smaller and very structured. For such systems the overhead of a parallel solve outweighs the benefits. A well may be solved on any processor and this allows the total work across all wells to be balanced. This is accomplished by extending the membership of "halo" cells to also include all the cells connected to the wells assigned to a given processor. Heuristics are used to determine well-to-processor assignment and to balance the extra overhead associated with the extended halos. These can be re-evaluated as the simulation advances to account for new wells or wells that, via workovers, alter their connectivity with the reservoir.

The time stepping algorithm is not the only source of well solves but it can be predictable. Supplementary field management strategies are determined on the master processor, which hides the complexity of the algorithms described above. Parallel computation, unless trivial, always entails additional communication and while bandwidth may be a concern in this area, latency can be important. There are two ways in which this issue is addressed. First, field management 304 gathers well solves together, which amortizes the communication over a greater packet of work. Secondly, the wells preemptively send their updated state to the master process, minimizing the communication across similar requests over time. It is only by considering this gathering step in addition to the distribution and balancing steps above that the benefits of parallel computation can be fully realized.

Field Management Interface

In the well system modeling platform 302, for reasons of flexibility and extensibility, the field management controller 304, which collectively controls fields, groups and networks, may be isolated from the rest of the modeling platform 302 via an interface 332, in contrast to previous simulators. Modeling complicated reservoir processes requires sophisticated field management algorithms that request many well model solves in each simulation time step. Most field operating strategies solve the wells in three different modes:

1. Operating mode—This is the mode at which the wells are intended to be operated in the real field. The well model constraints 218 may include user-specified pressure and rate constraints corresponding to physical flow limitations of the wellbore, and additional rate constraints to choke the well to meet facility targets and limits.

2. Deliverable mode—The deliverable rate is the physical amount that the well would produce if all the facility restrictions were removed, leaving only wellbore constraints. This is useful in determining whether a field can deliver contractual amounts at any given time.

3. Potential mode—The potential of a well is the hypothetical rate at which the well would produce if all wellbore and facility rate limits were removed, leaving only wellbore pressure constraints. Well potentials are used in rate allocation algorithms.

The interface 332 between the well system modeling platform 302 and the field management controller 304 recognizes these differing modes and to facilitate efficient well solves, the modeling platform 302 has three solution spaces corresponding to the three modes. This ensures that, for example, a potential solve starts from the last potential solution of the well and not the last well solution which may have been made under its operating mode with quite different rates and pressures.

The isolated solver 330 provides another efficiency increase. A field management well solution to balance a network or to apportion group targets may not need the G and H matrices to be calculated. These "what if" type solves are referred to as isolated solves, whilst those well solves that are involved in the time stepping simulation are referred to as coupled solves, during which well G and H matrices do need to be calculated.

In one implementation, the field management controller 304 does not control when the isolated solves are to be performed, but instead requests properties from a well, for example, an oil potential volume rate. Once the well system modeling platform 302 receives this request it decides whether its potential solve is up-to-date. If the solve is up to date, then the value is returned; if not, the well is solved in this mode and then the value is returned. Reasons for a well solution being out-of-date might be a change in reservoir state since the last solve in a given mode, or a change in constraints 218 applied to the well.

To minimize parallel communication, the field management controller 304 gathers together a collection of properties needed for a collection of wells and then makes one request from the well system modeling platform 302.

Example Methods

Figure 10:
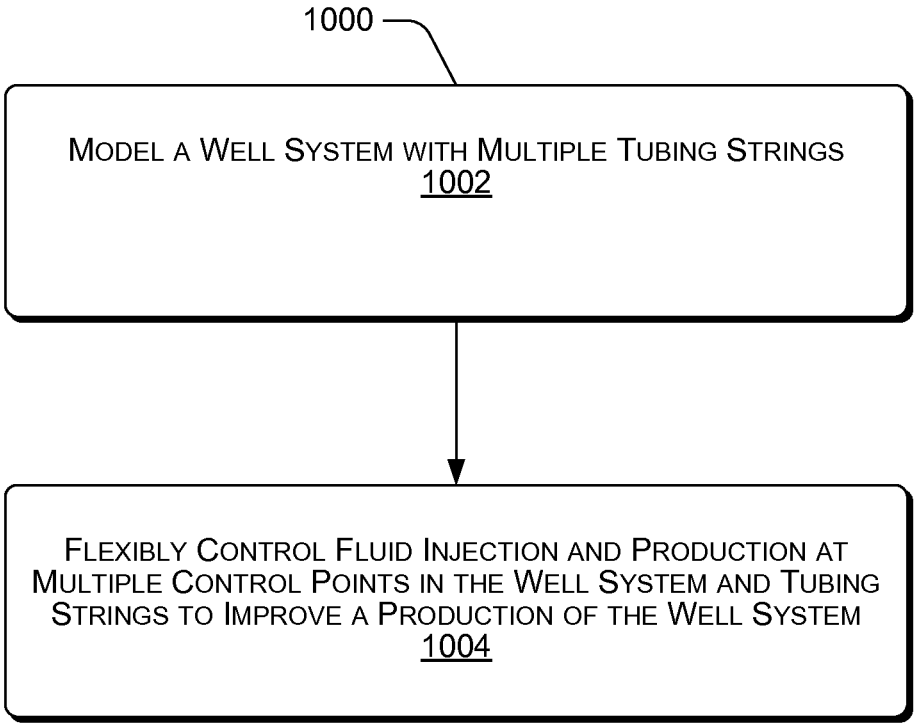
FIG. 10 is a flow diagram of an example method of designing and controlling a well system with multiple tubing strings.

FIG. 10 shows an example method 1000 of designing and controlling a well system with multiple tubing strings. In the flow diagram, the operations are summarized in individual blocks. The example method 1000 may be performed by hardware or combinations of hardware and software, for example, by the multi-segment wellbore modeler 120 or the well system modeling platform 302.

At block 1002, a well system is modeled with multiple tubing strings.

At block 1004, fluid injection and production are flexibly controlled at multiple control points in the well system and tubing strings to improve a production of the well system.

Figure 11:
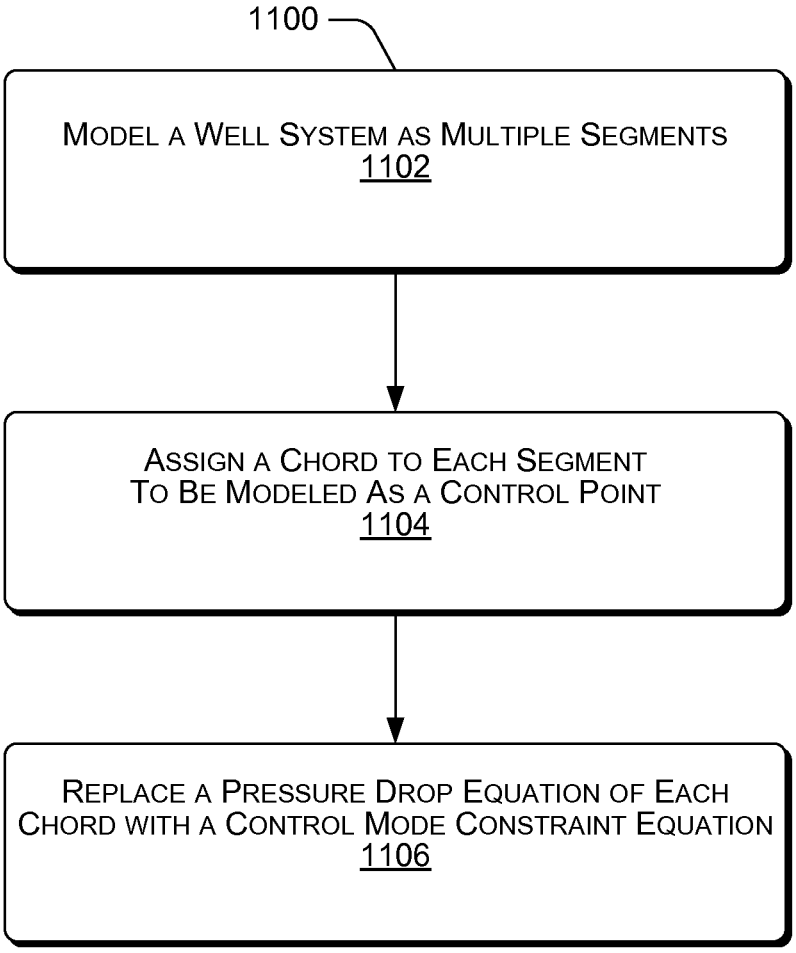
FIG. 11 is a flow diagram of an example method of modeling multiple control points in a multi-segment well system.

FIG. 11 shows an example method 1100 of modeling multiple control points in a multi-segment well system. In the flow diagram, the operations are summarized in individual blocks. The example method 1100 may be performed by hardware or combinations of hardware and software, for example, by the multi-segment wellbore modeler 120 or the well system modeling platform 302.

At block 1102, a well system is modeled as multiple segments.

At block 1104, a chord is assigned to each segment to be modeled as a control point. Each chord consists of an extra pipe connected to the node of a segment, wherein the other end of the extra pipe, the "outer end," is left unattached as if a conduit to the surface.

At block 1106, a pressure drop equation associated with the segment being modeled with a control point is replaced with a control mode constraint equation.

Figure 12:
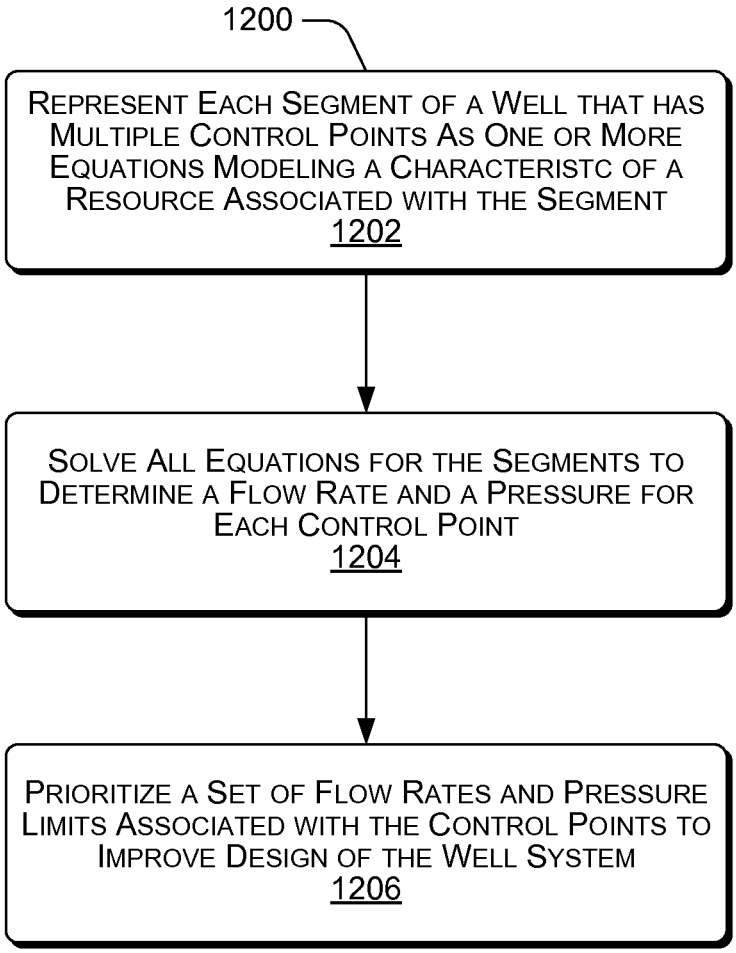
FIG. 12 is a flow diagram of an example method of designing and controlling a well system with multiple tubing strings.

FIG. 12 shows an example method 1200 of designing and controlling a well system with multiple tubing strings. In the flow diagram, the operations are summarized in individual blocks. The example method 1200 may be performed by hardware or combinations of hardware and software, for example, by the multi-segment wellbore modeler 120 or the well system modeling platform 302.

At block 1202, each segment of a well system with multiple control points is represented as one or more equations modeling a characteristic of a resource associated with the segment.

At block 1204, equations for all the segments are solved to determine a flow rate and a pressure for each control point.

At block 1206, a set of flow rates and pressure limits associated with the control points is prioritized to improve design of the well system.

Figure 13:
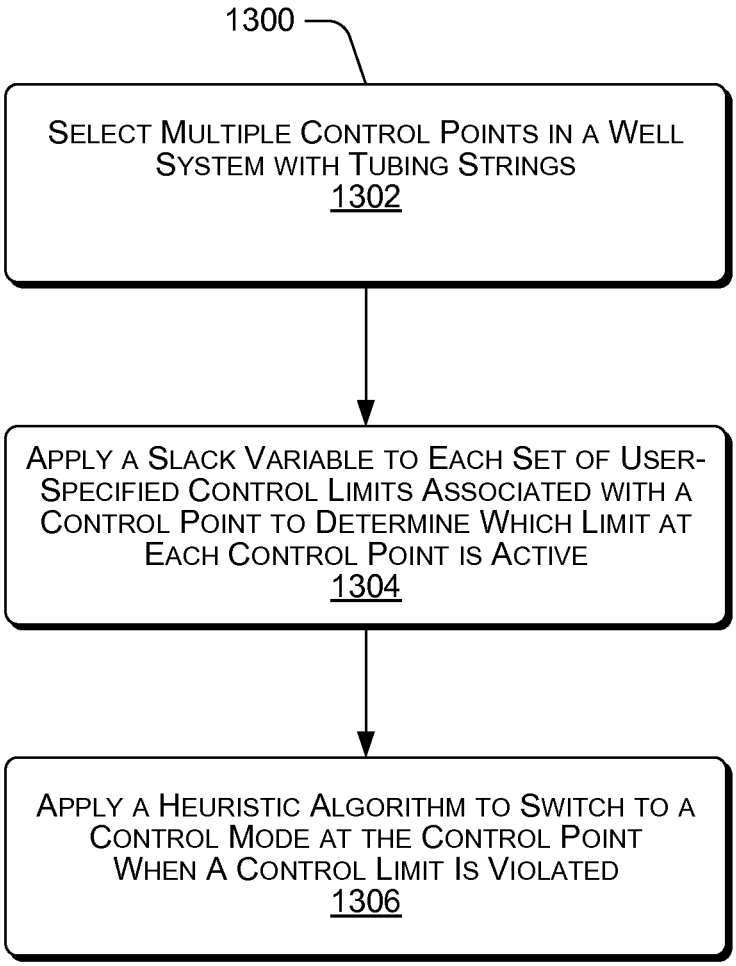
FIG. 13 is a flow diagram of an example method of controlling a well system with multiple tubing strings.

FIG. 13 shows an example method 1300 of controlling a well system with multiple tubing strings. In the flow diagram, the operations are summarized in individual blocks. The example method 1300 may be performed by hardware or combinations of hardware and software, for example, by the multi-segment wellbore modeler 120 or the well system modeling platform 302.

At block 1302, multiple control points are selected in a well system that has tubing strings.

At block 1304, a slack variable is applied to each set of user-specified control limits associated with a control point to determine which limit at each control point is active.

At block 1306, when a control limit is violated at a control point, a heuristic algorithm is applied to switch to a control mode at the control point.

Figure 14:
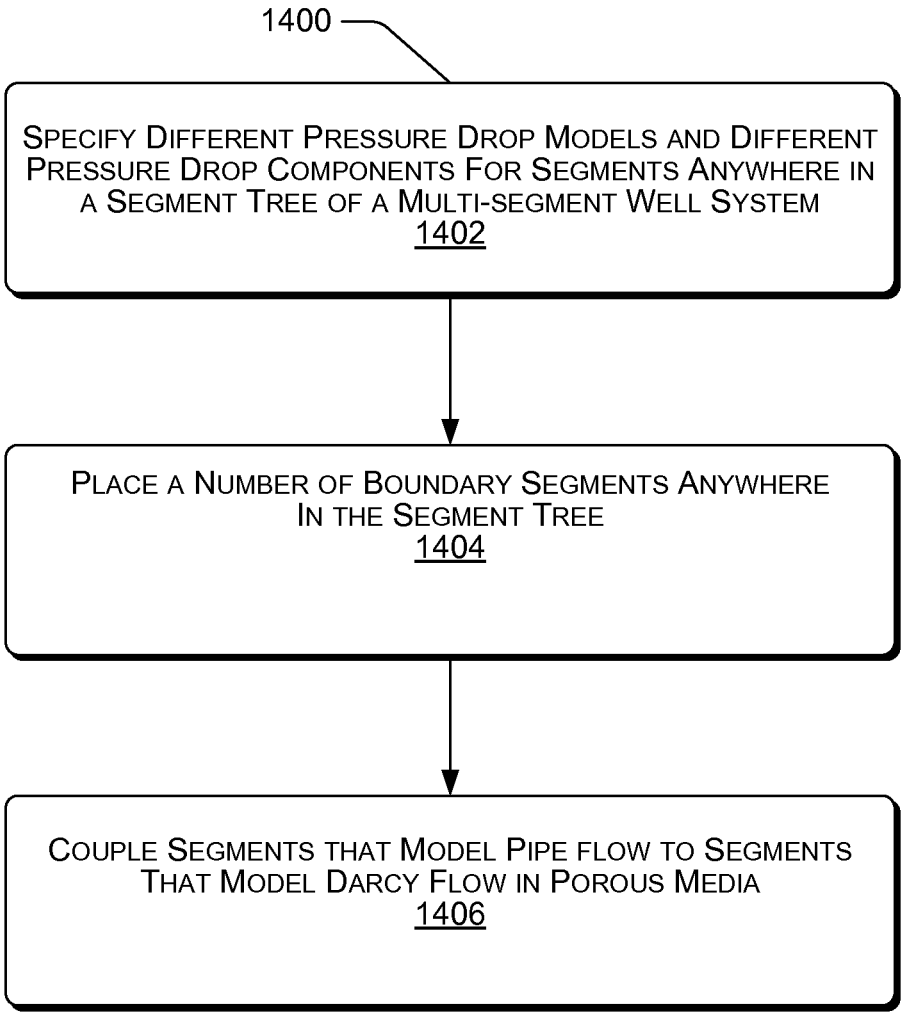
FIG. 14 is a flow diagram of an example method of designing well system with multiple tubing strings.

FIG. 14 shows an example method 1400 of designing well system with multiple tubing strings. In the flow diagram, the operations are summarized in individual blocks. The example method 1400 may be performed by hardware or combinations of hardware and software, for example, by the multi-segment wellbore modeler 120 or the well system modeling platform 302.

At block 1402, different pressure drop models and different pressure drop components are specified for segments anywhere in a segment tree of a multi-segment well system.

At block 1404, a number of boundary segments are placed anywhere within the segment tree.

At block 1406, segments that model pipe flow are coupled to segments that model Darcy flow in porous media.

Figure 15:
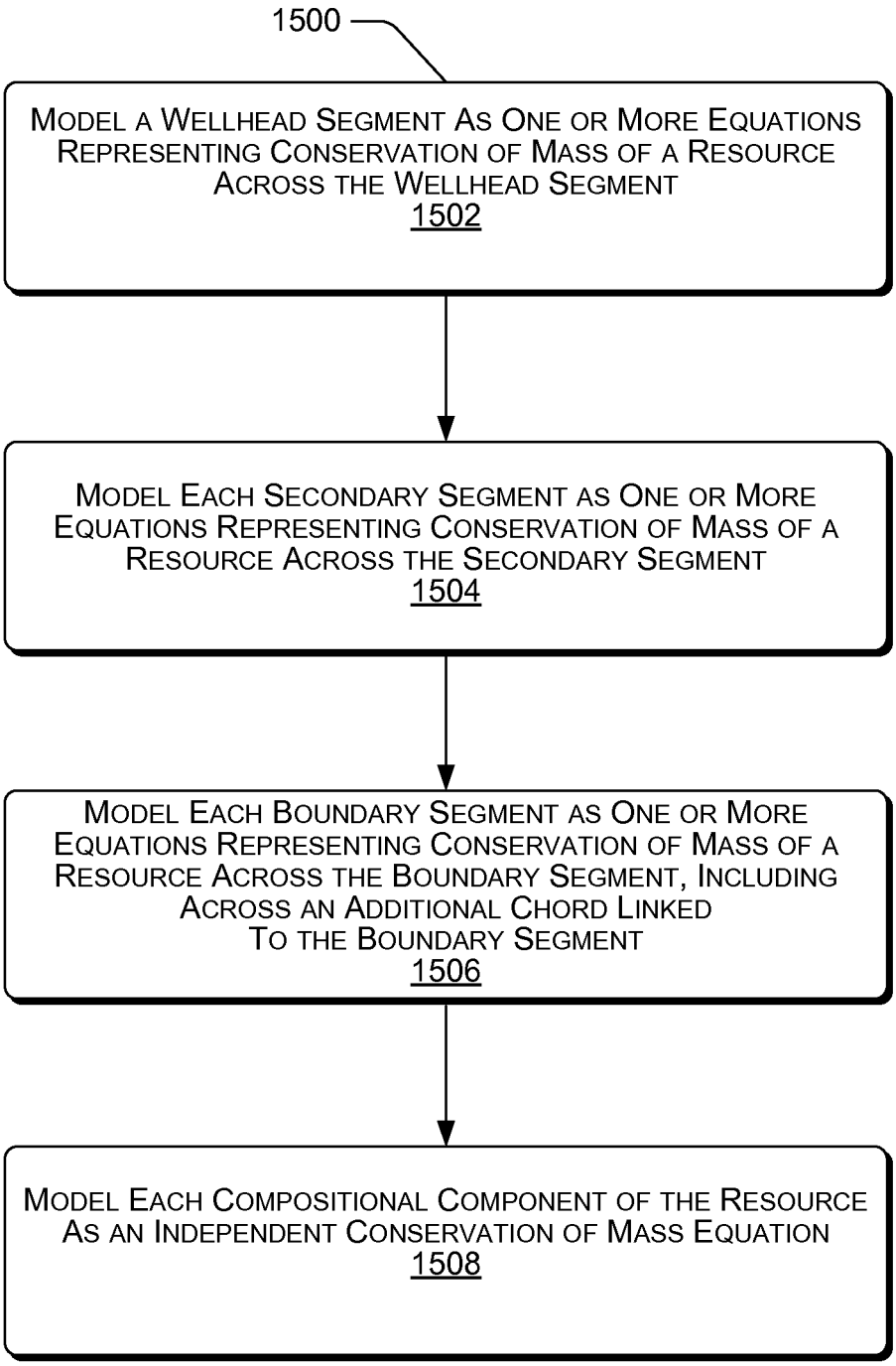
FIG. 15 is a flow diagram of an example method of modeling a multi-segment well system that possesses multiple tubing strings.

FIG. 15 shows an example method 1500 of modeling a multi-segment well system that possesses multiple tubing strings. In the flow diagram, the operations are summarized in individual blocks. The example method 1500 may be performed by hardware or combinations of hardware and software, for example, by the multi-segment wellbore modeler 120 or the well system modeling platform 302.

At block 1502, a wellhead segment is modeled as one or more equations representing a conservation of mass of a resource across the wellhead segment.

At block 1504, each secondary segment is modeled as one or more equations representing a conservation of mass of a resource across the secondary segment.

At block 1506, each boundary segment is modeled as one or more equations representing a conservation of mass of a resource across the boundary segment, including across an additional chord linked to the boundary segment.

At block 1508, each compositional component of the resource is also modeled with an individual conservation of mass equation, for example for various liquid and vapor phases of the resource.

Figure 16:
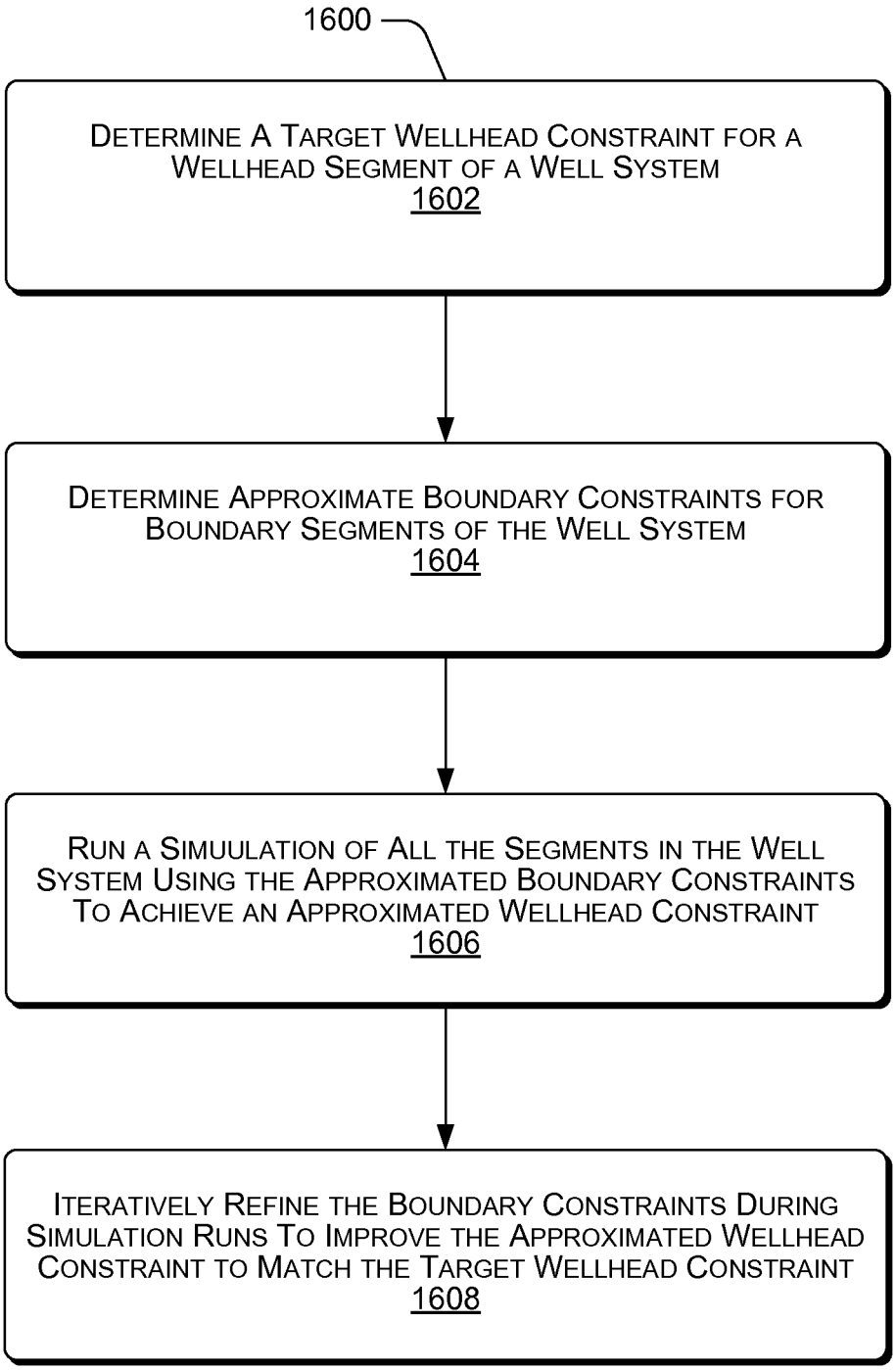
FIG. 16 is a flow diagram of an example method of heuristically determining constraints for multiple control points in a well system with tubing strings.

FIG. 16 shows an example method 1600 of heuristically determining constrains for multiple control points in a well system with tubing strings. In the flow diagram, the operations are summarized in individual blocks. The example method 1600 may be performed by hardware or combinations of hardware and software, for example, by the multi-segment wellbore modeler 120 or the well system modeling platform 302.

At block 1602, a target wellhead constraint for a wellhead segment of the well system is determined.

At block 1604, approximate boundary constraints for boundary segments of the well system are determined.

At block 1606, a simulation of all the segments in the well system is run using the approximated boundary constraints to achieve an approximated wellhead constraint.

At block 1608, the boundary constraints are iteratively refined during simulation runs to improve the approximated wellhead constraint to match the target wellhead constraint.

CONCLUSION

Although exemplary systems and methods have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

The invention claimed is:

1. A non-transitory computer-readable storage medium, containing instructions, which when executed by a computer perform a process, comprising:

modeling a well system including multiple tubing strings;

flexibly controlling fluid injection and production at multiple control points in the well system and tubing strings to improve a production of the well system;

calculating a molar inflow rate for at least one of the control points of the well system;

applying one or more blocking factors to the molar inflow rate;

updating a lookup table if an inflow region deviates from steady state; and wherein an update frequency of the lookup table is directly proportional to a magnitude of the deviation.

2. The computer-readable storage medium of claim 1, wherein the process further comprises flexibly controlling fluid injection and production at the control points in a real world well system via a communication interface.

3. The computer-readable storage medium of claim 1, wherein the process further comprises:

modeling the well system as multiple segments;

selecting some of the multiple segments to possess control points;

modeling each segment selected to possess a control point as a boundary segment, including:

assigning a chord to each segment to be modeled as a boundary segment;

wherein each chord comprises an extra pipe connected to a node of the corresponding segment, the outlet end of the extra pipe left unattached;

wherein a pressure drop equation associated with the segment being modeled as a boundary segment is replaced with a control mode constraint equation; and wherein the process includes specifying a boundary segment at any number of points within the segment tree.

4. The computer-readable storage medium of claim 3, wherein the process further comprises:

modeling each segment as one or more equations, wherein each equation models at least a characteristic of a resource associated with the segment; and solving all the equations for all the segments to convergence to predict a flow of fluids and energy that satisfies production targets, injection targets, and selected constraints for the boundary conditions.

5. The computer-readable storage medium of claim 4, wherein the process further comprises:

a constraint prioritizer for prioritizing and selecting flow rate and pressure limit constraints associated with each control point.

6. The computer-readable storage medium of claim 3, wherein the process of modeling each segment further comprises:

modeling a wellhead segment as one or more equations;

modeling each secondary segment as one or more equations; and modeling boundary segments as one or more equations including an equation representing a pressure drop across an additional chord linked to the segment, wherein the chord represents a pressure drop between the boundary segment and a surface of the well system.

7. The computer-readable storage medium of claim 3, further comprising one of:

specifying different pressure drop models and pressure drop components for any segment in the segment tree;

placing any number of boundary segments within the segment tree; and specifying segments that model pipe flow, fully coupled to segments that model Darcy flow in porous media.

8. The computer-readable storage medium of claim 6, wherein the process further comprises applying a slack variable on each control point in order to determine which constraint at each control point is active or inactive;

wherein the process further comprises applying a slack variable and a multiplier to each constraint specified by a user for a control point; and wherein the constraints for the control point are selected from a group of constraints consisting of oil production rate, water production rate, and pressure limit.

9. The computer-readable storage medium of claim 6, wherein the process of modeling each segment further comprises:

modeling the wellhead segment as one or more equations representing overall injection, overall production, and overall mass conservation;

modeling each secondary segment as one or more equations to represent conservation of mass across the segment and pressure drop across the segment; and modeling each boundary segment as one or more equations to represent conservation of mass across the boundary segment, pressure drop across the segment, and pressure drop across the additional chord linked to the segment.

10. The computer-readable storage medium of claim 6, wherein modeling the segments as one or more equations further comprises modeling each compositional component of the resource with an individual conservation of mass equation.

11. The computer-readable storage medium of claim 6, wherein the process further comprises modeling the segments with conservation of energy equations when the resource has a thermal characteristic.

12. The computer-readable storage medium of claim 6, wherein the process further comprises:

applying a heuristic model for determining rate flow and pressure constraints for the control points, including:

determining a target wellhead constraint for the wellhead segment;

approximating boundary constraints for the boundary segments;

running a simulation of all the segments in the well system using the approximated boundary constraints to achieve approximated wellhead constraints;

iteratively refining the boundary constraints to improve the approximated wellhead constraints to match the target wellhead constraint; and wherein when a boundary constraint of a boundary segment is violated during the iterative refining, then switching the boundary constraint to a different control mode.

13. A computer-executable method, comprising:

modeling a well system of multiple tubing strings as segments;

modeling each segment as one or more equations describing one or more characteristics of a fluid resource associated with the segment;

establishing multiple control points in the well system;

solving the equations to convergence to predict flow rates, pressures, and flow of energy to satisfy production or injection targets and to satisfy selected constraints for the control points;

wherein the constraints further comprise a steam trap constraint for forcing at least one segment of the well into a sub-cooled condition and a steam production constraint for limiting production from at least one segment of the well based upon one or more water vapor inflow values;

applying different operating strategies for determining the constraints, each operating strategy associated with a triggering criterion to modify a topology of the well system to improve a production of the well system or to balance a production of the well system; and wherein modifying the topology includes one of opening a well, closing a completion, or changing a boundary condition of the well system.

14. The computer-executable method of claim 13, further comprising calculating the flowing conditions of the well system iteratively with different constraint sets, wherein the constraint sets include:

an operating constraint set that includes all well system constraints and constraints imposed from group or field operating strategies;

a deliverable constraint set that includes only the flow rate and pressure constraints of the well system; and a potential constraint set that includes only pressure constraints of the well system.

15. The computer-executable method of claim 13, wherein modeling each segment as one or more equations comprises formulating the equations to describe multi-component mass and energy conservation across the multiple segments.

16. The computer-executable method of claim 13, wherein modeling each segment as one or more equations comprises formulating the equations to describe one of:

a global phase-component partitioning model;

a conductive heat transfer model;

a pseudo-pressure model;

non-Darcy flow model; and a separator model.

17. A non-transitory computer-readable storage medium, containing instructions, which when executed by a computer perform a process, comprising:

modeling a multi-segment well system of multiple tubing strings as equations, each equation associated with a segment and each equation describing one or more physical characteristics of a fluid resource associated with the segment;

modeling a node and a pipe of each segment individually to accommodate chords and devices affecting pressure and rate flow;

assigning an open chord to selected nodes to create multiple control points;

solving the equations to convergence to predict a flow of fluids and energy to satisfy a production target subject to user-specified constraints for the control points; and applying the converged equations to improve a production of the fluid resource;

calculating surface phase volumes for each phase of the fluid resource;

establishing stages of a separator chain at different temperatures and pressures;

flashing component molar rates of surface phase volumes to thermodynamic equilibrium at a first stage in the separator chain;

directing an outlet stream from a phase outlet for each of the equilibrated phases to subsequent stages in the separator chain or to an overall separator outlet for the individual phase;

wherein a fluid from a phase outlet of any separator stage can be split and sent to different downstream stages; and wherein the split can be based on a volume fraction or volume rate for each phase outlet.

18. The computer-readable storage medium of claim 17, wherein the process further comprises:

rearranging the segments to improve production of the fluid resource;

wherein the segments include one of a bottom hole segment, a wellhead segment, a gas lift segment, a segment enabling circulation, or a segment having a downhole control mode; and wherein the bottom hole segment can be placed in a segment tree at positions other than the lowest measured depth.

* * * * *